US011338894B1

(12) United States Patent
Bay

(10) Patent No.: US 11,338,894 B1
(45) Date of Patent: May 24, 2022

(54) AUXILIARY LOW-SPEED MARINE STEERING ASSOCIATED WITH INVERTED SNORKEL FOR UNDERWATER ENGINE EXHAUST

(71) Applicant: Jonathan A. Bay, Ozark, MO (US)

(72) Inventor: Jonathan A. Bay, Ozark, MO (US)

( * ) Notice: Subject to any disclaimer, the term of this patent is extended or adjusted under 35 U.S.C. 154(b) by 13 days.

(21) Appl. No.: 16/932,103

(22) Filed: Jul. 17, 2020

Related U.S. Application Data

(63) Continuation-in-part of application No. 16/844,108, filed on Apr. 9, 2020, now abandoned.

(60) Provisional application No. 62/831,881, filed on Apr. 10, 2019, provisional application No. 63/023,311, filed on May 12, 2020.

(51) Int. Cl.

| | |
|---|---|
| ***B63H 21/32*** | (2006.01) |
| ***B63H 19/06*** | (2006.01) |
| ***B63H 25/38*** | (2006.01) |
| ***B63H 11/14*** | (2006.01) |
| ***B63H 11/113*** | (2006.01) |
| ***B63H 25/46*** | (2006.01) |
| *B63H 25/02* | (2006.01) |
| *F01N 13/12* | (2010.01) |

(52) U.S. Cl.
CPC ..... *B63H 19/06* (2013.01); *B63H 11/113* (2013.01); *B63H 11/14* (2013.01); *B63H 25/38* (2013.01); *B63H 25/46* (2013.01); *B63H 2025/022* (2013.01); *F01N 13/12* (2013.01)

(58) Field of Classification Search
CPC ..... F01N 13/12; B63H 25/38; B63H 25/46; B63H 11/14; B63H 19/06
See application file for complete search history.

(56) References Cited

U.S. PATENT DOCUMENTS

| | | | | |
|---|---|---|---|---|
| 1,313,537 A | | 8/1919 | Jones | H02K 7/14 |
| 1,889,173 A | | 11/1932 | Drexler | B21B 39/008 |
| 2,966,078 A | | 12/1960 | Wright | F16H 1/32 |
| 3,892,144 A | | 7/1975 | Kirkegaard | B65G 23/08 |
| 4,276,940 A | | 7/1981 | Kirkegaard | A01B 33/027 |
| 4,643,685 A | * | 2/1987 | Nishida | B63H 11/08 440/42 |

(Continued)

FOREIGN PATENT DOCUMENTS

| | | | |
|---|---|---|---|
| JP | S61268594 A | 5/1985 | B63H 25/42 |
| WO | WO 02/085702 | 10/2002 | B63H 21/22 |

(Continued)

OTHER PUBLICATIONS

Drum motor, https://en.wikipedia.org/w/index.php?title=Drum_motor&oldid=924733058 (last visted Jul. 17, 2020).

*Primary Examiner* — Andrew Polay
(74) *Attorney, Agent, or Firm* — Jonathan A. Bay

(57) ABSTRACT

An improvement for inboard motor boats has a rigid exhaust conduit, a miniature rudder, and a rudder control system. The rigid conduit is provided for conduction of combustion gases exhaust outside the hull and has an aft facing outlet. The miniature rudder is pivotably mounted on the rigid conduit relative the aft facing outlet whereby combustion gases exhaust past the rudder. The rudder control system has a user interface inside the boat and has a control mechanism pivoting the rudder in response to inputs to the user interface.

17 Claims, 23 Drawing Sheets

(56) References Cited

U.S. PATENT DOCUMENTS

| | | | | |
|---|---|---|---|---|
| 5,016,553 | A * | 5/1991 | Spencer | B63H 25/46 114/151 |
| 5,491,636 | A | 2/1996 | Robertson et al. | G06F 165/00 |
| 6,132,267 | A | 10/2000 | Campbell | B63H 5/08 |
| 6,325,010 | B1 | 12/2001 | Gruenwald | B63H 25/46 |
| 6,520,813 | B1 | 2/2003 | DeVito, Jr. | B63H 20/007 |
| 6,655,309 | B1 | 12/2003 | Stephens | B63H 21/213 |
| 6,865,997 | B2 | 3/2005 | Stephens | B62H 25/46 |
| 7,104,212 | B2 | 9/2006 | Brianza | B63H 21/21 |
| 7,387,555 | B1 * | 6/2008 | Mann | B63H 21/32 440/89 E |
| 7,497,748 | B2 | 3/2009 | Salmon | B63B 39/061 |
| 7,789,032 | B1 | 9/2010 | McDugle et al. | B63H 25/46 |
| 7,887,381 | B2 | 2/2011 | Brass et al. | G01C 21/203 |
| 8,651,908 | B1 * | 2/2014 | Glodowski | B63H 11/08 440/89 R |
| 8,939,104 | B2 | 1/2015 | Holesz | B63H 5/14 |
| 10,202,181 | B2 | 2/2019 | Suzuki et al. | B63H 21/17 |
| 10,331,137 | B2 | 6/2019 | Miller et al. | G05D 1/02 |
| 10,782,690 | B1 | 9/2020 | Miller et al. | G05D 1/0206 |
| 10,953,794 | B2 | 3/2021 | Griffin et al. | B63H 20/02 |
| 2007/0111616 | A1 | 5/2007 | McAleer, Jr. et al. | B63H 11/08 |
| 2017/0349247 | A1 * | 12/2017 | Herrington | B63H 25/38 |

FOREIGN PATENT DOCUMENTS

| | | | |
|---|---|---|---|
| WO | WO 2008/108664 | 9/2008 | B63H 25/42 |
| WO | WO 2014/062113 A1 | 4/2014 | B63B 39/08 |

* cited by examiner 202
214
210a
112
VI-VI
210a 200
210
44
212
214
42
208

AUXILIARY LOW-SPEED MARINE STEERING ASSOCIATED WITH INVERTED SNORKEL FOR UNDERWATER ENGINE EXHAUST

CROSS-REFERENCE TO PROVISIONAL APPLICATION(S)

This application is a continuation-in-part of U.S. patent application Ser. No. 16/844,108, filed Apr. 9, 2020; which claims the benefit of U.S. Provisional Application No. 62/831,881, filed Apr. 10, 2019.

This application claims the benefit of U.S. Provisional Patent Application No. 63/023,311, filed May 12, 2020.

The foregoing patent disclosures are fully incorporated herein by this reference thereto.

BACKGROUND AND SUMMARY OF THE INVENTION

The invention relates to water vessel propulsion and, more particularly, to auxiliary low-speed marine steering apparatus associated with or mounted to an inverted snorkel for submerging underwater engine exhaust gases, or the feed conduits therefor.

It is an aspect of the invention that the auxiliary low-speed marine steering (and/or low speed propulsion) provisions in accordance with the invention serve such purposes as providing slow-speed relatively fine control over slight steering adjustments for inboard pleasure boats, for maneuvers like docking into slips, loading onto trailers, pulling alongside fuel docks and the like.

A typical class of such inboard pleasure boats includes inboard wake boats or inboard ski boats and the like. There are two factors (among many others) which typify these boats. They have the poorest steering control at low speed compared to outboard drives and I/O drives (ie., inboard/outboard drives, or also sterndrives), by a wide margin of poorness. Inboard drives steer so poorly at slow speeds because they have a fixed prop and are thus steered by a rudder. When slowly making headway under "no-wake" restrictions in marinas and boat launches, there is such a weak water flow going past the rudder that there is virtually no steering.

To turn to another matter, it is popular to add an accessory to inboard boats for ski and wake sports that comprises an inverted snorkel for exhausting the engine exhaust gases underwater and more or less symmetrically with the centerline of the prop. This not only to submerges and disperses carbon monoxide emissions in the exhaust gases but also quiets the engine noise down substantially, which in consequence enhances the enjoyment of the music system by the boat. That is, another typical feature ski and wake boats include being outfitted with high quality music sound systems (not shown), or at least music sound systems which are much cherished by the owner.

It is an object of the invention to provide solutions for the foregoing slow speed steering problem by making an opportunity out of the inverted snorkel for engine exhaust.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figure 1:
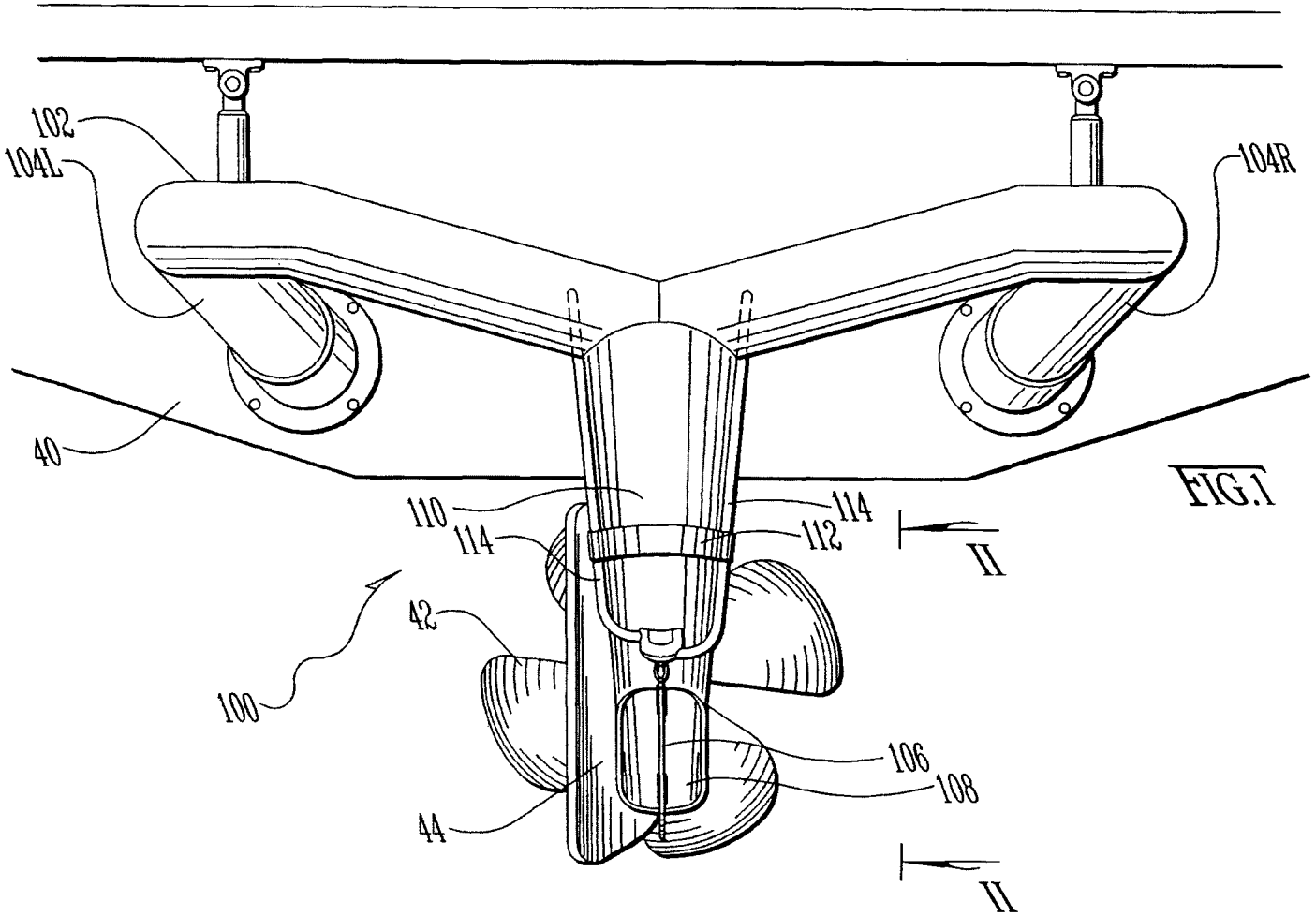
FIG. 1 is an end elevational view of an inverted snorkel for submerging engine exhaust gases symmetrically (or thereabouts) with the centerline of the prop, as well as dual exhaust-gas feeder tubes therefor, equipped with auxiliary low-speed marine steering apparatus in accordance with the invention.

Pleasure and/or sport boating activities are popular as ever over the last several decades. This includes skiing, wake surfing, wakeboarding, tubing (ie., inflatable towing in general), as well as bare-footing, knee-boarding, wake skating and so on.

Also popular are inboard drive sports boats 40 designed specifically for one or the other of such activities, or perhaps cross-over inboard drive sports boats 40 designed for two or several of the activities. The cost of new inboard wake sport boat 40 is on a current trend of increasing exponentially with every new year. In the winter time boat shows, new inboard wake sport boats 40 are overtaking or on their way to overtaking the high end sport boat market (eg., the other class of boats being I/O drives (or else inboard/outboard drives and, also called stern drives)).

There are two factors (among many others) which typify inboard drive sports boats 40 relative to the objects of the present invention. Inboard drive boats 40 have the poorest steering control at low speed compared to outboard drives and I/O drives (ie., inboard/outboard drives, or also stern-drives), and by a wide margin of poorness. Inboard drive boats 40 steer so poorly at slow speeds because they have a fixed prop 42 and are thus steered by a rudder 44. When slowly making headway under "no-wake" restrictions in marinas and boat launches, there is such a weak water flow going past the rudder 44 that there is virtually no steering.

To turn to another matter, it is popular to add an accessory to inboard drive sports boats 40 for ski and wake sports that comprises an inverted snorkel (eg., 102 in FIG. 1) for exhausting the engine exhaust gases underwater and more or less symmetrically with the centerline of the prop 42. This not only to submerges and disperses carbon monoxide emissions in the exhaust gases but also quiets the engine noise down substantially, which in consequence enhances the enjoyment of the music system by the inboard drive sports boat 40. That is, another typical feature ski and wake boats 40 have include being outfitted with high quality music sound systems, or at least music sound systems which are much cherished by the owner.

Moreover, the engines for the upscale inboard ski and wakeboats 40 are almost universally gasoline-powered internal combustion engines. Most of the brands of such gasoline-powered internal combustion engines are domestic. And most use either one or the other of an old-school GM® block or old-school FORD® block, which only survive nowadays for being marinized for the marine market (these old engine blocks are no longer sold in new cars).

And being the good old work-horse beasts they are, the old-school gasoline-powered internal combustion engine can be reckoned as just huge powerful air moving equipment.

That is, they suck in a huge flowrate of air, and they blow it out as a huge stream of exhaust gases.

It is an object of the invention for certain embodiments of the invention to take advantage of that circumstance, in combination with inverted snorkel apparatus (eg., 102 in FIG. 1) popular for submerging engine exhaust gases symmetrically (or thereabouts) with the centerline of the prop 42.

I

Figure 14:
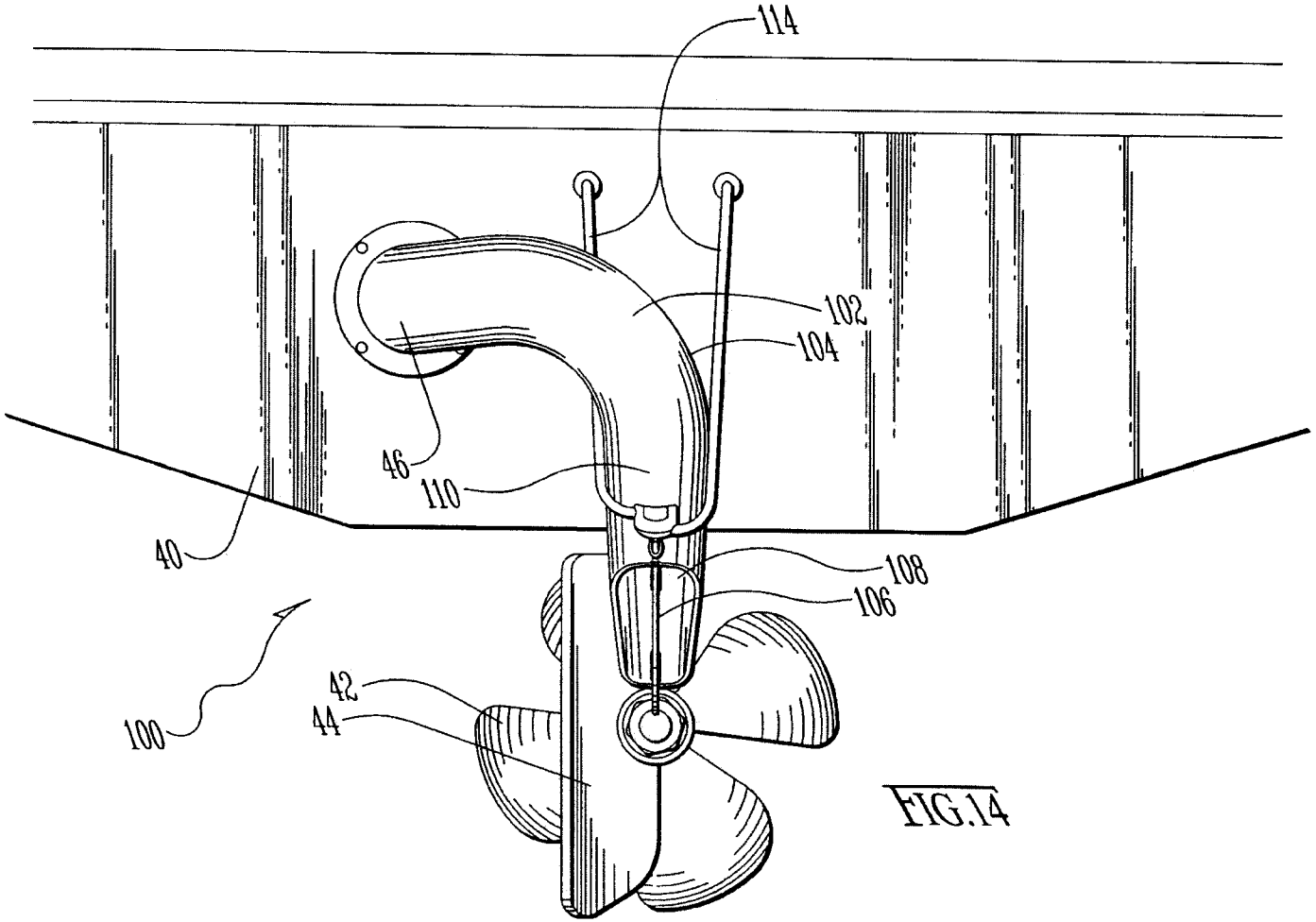
FIG. 14 is an end elevational view comparable to FIG. 1, showing the first embodiment of auxiliary low-speed marine steering apparatus in accordance with the invention, except this inverted snorkel has a single exhaust-gas feeder tube for a single exhaust engine rather than dual tubes for dual exhaust engines as shown in the previous views.

FIGS. 1-4 and FIG. 14 show a first embodiment of auxiliary low-speed marine steering apparatus 100 in accordance with the invention for inverted snorkel apparatus 102 that submerges engine exhaust gases symmetrically (or so) with the centerline of the prop 42. In FIG. 1, the inverted snorkel apparatus 102 is configured with dual exhaust-gas feeder tubes 104L and 104R therefor. In FIG. 14, the inverted snorkel apparatus 102 is configured with a single exhaust-gas feeder tube 104 for a single exhaust 46, inboard drive sports boat 40.

The auxiliary low-speed marine steering apparatus 100 comprises a miniature rudder 106 placed in the terminal outlet 108 of the inverted snorkel 102. At cruising speeds, the miniature rudder 106 is preferably stationary for straight ahead thrust. Additionally, the miniature rudder 106 is preferably stationary for straight ahead thrust so it provides negligible restriction to the passage of exhaust gases at high engine RPM's. The main rudder 44 provides the steering at cruising speeds. In general, for inboard motor boats 40, the main rudder 44 doesn't really provide good steering control until about five miles-per-hour (~eight kmh).

As poor as the main rudders 44 perform for inboard drive sports boats 40 at slow-speed, everything changes at cruising speed. An inboard drive sports boat 40 designed for elite slalom skiing can do incredible things. At straight line speed of thirty miles an hour or so (~fifty-eight kph), the driver can throw the main rudder 44 hard to one side and thus throw the inboard drive sports boat 40 in a one-hundred and eighty degree flat spin ("Power Slide"). This maneuver probably requires a direct-drive inboard-drive sports boat 40. But here is how to do a Power Slide. Get the boat 40 up to top speed and then bring the boat 40 just barely in gear while turning the wheel quickly to the right. The boat 40 will "slide" (hence Power Slide) or, that is, spin one-hundred and eighty degrees like a jet ski. This is not advised for amateurs but it is commonly performed for entertainment at ski shows:—with skiers in tow.

However and again, at low speeds, the main rudder 44 is pitiful at providing meaningful steering control. At low speeds, it is an aspect of the invention to provide the user with an auxiliary low-speed marine steering option 100 in accordance with the invention.

The auxiliary low-speed marine steering apparatus 100 in accordance with the invention comprises a miniature rudder 106 placed in the terminal outlet 108 of the inverted snorkel 102. This miniature rudder 106 is steered or controlled by a user in the helm 48 of the inboard drive sports boat 40 for left or right thrust vectoring.

The engine exhaust provides the thrust. In other words, at slow speeds, the engine exhaust provides the thrust. Correspondingly, at slow speeds, the miniature rudder 106 vectors the thrust. Also, at slow speeds, the engine is presumptively turning a fraction of the RPM's as at top speed. Hence the exhaust stream outflow as slow speeds is likewise a fraction of that at high speeds. Still, it is sufficient of an exhaust stream outflow that can be vectored by the miniature rudder 106 nonetheless, for providing some steering control, no matter how minute.

Figure 2:
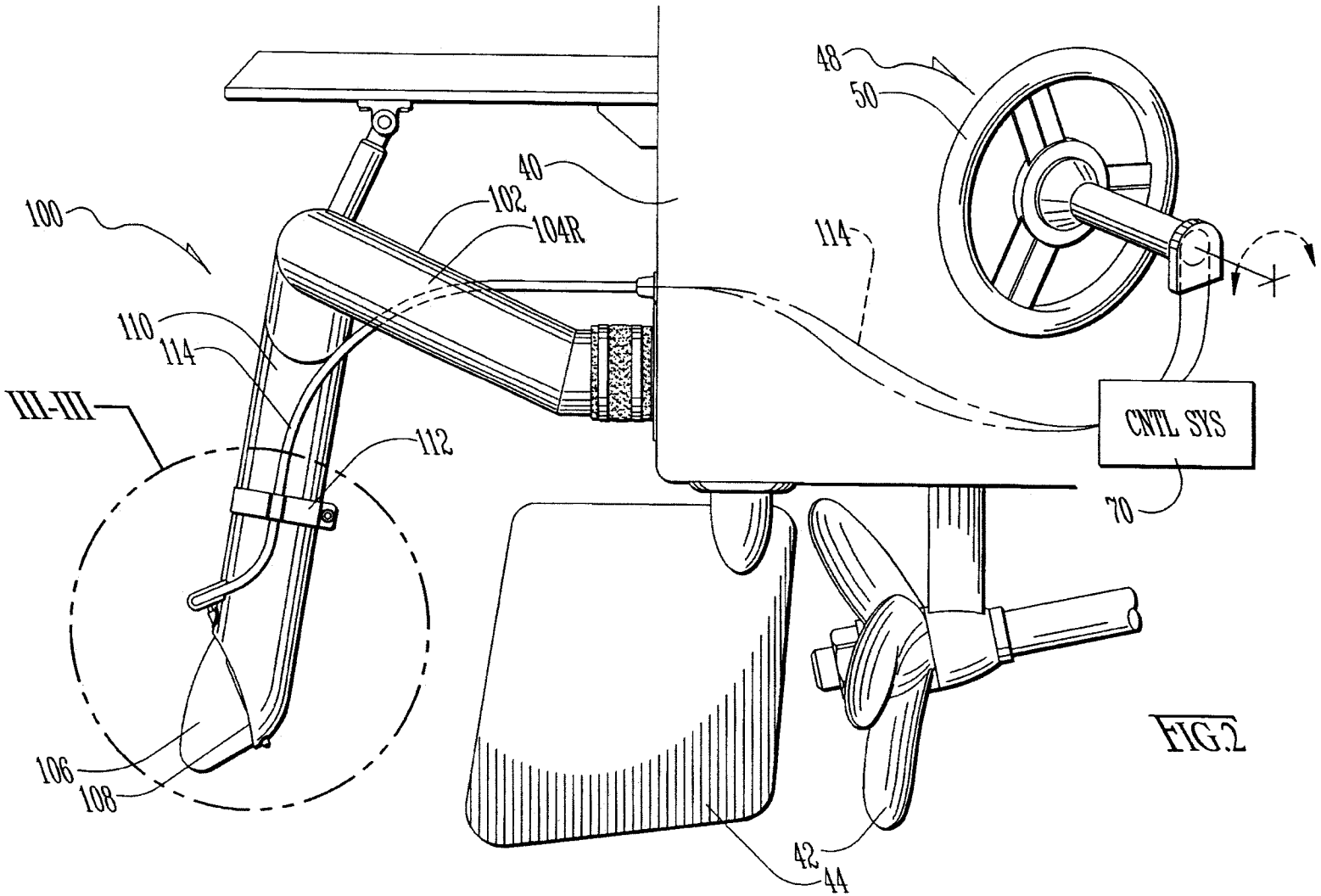
FIG. 2 is a side elevational view taken in the direction of arrows II-II in FIG. 1, and including an inset in perspective showing the main steering wheel in the helm of the boat.
Figure 3:
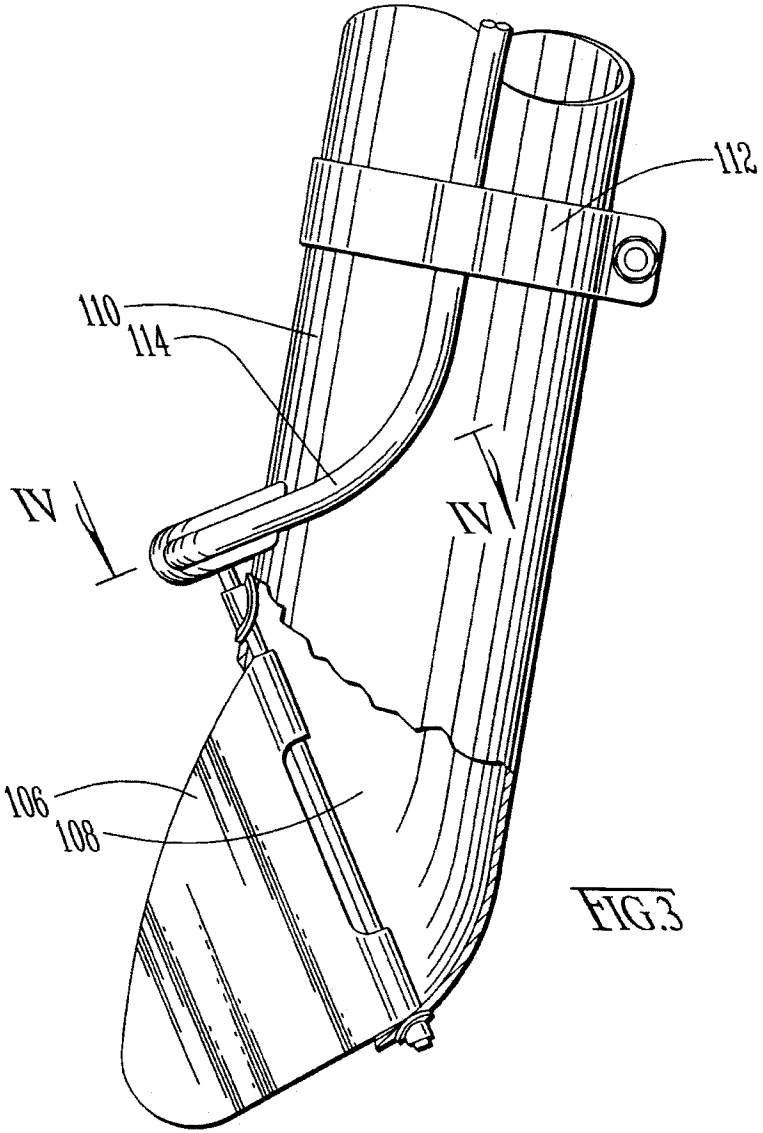
FIG. 3 is an enlarged-scale side elevational view of detail III-III shown in FIG. 2.
Figure 4:
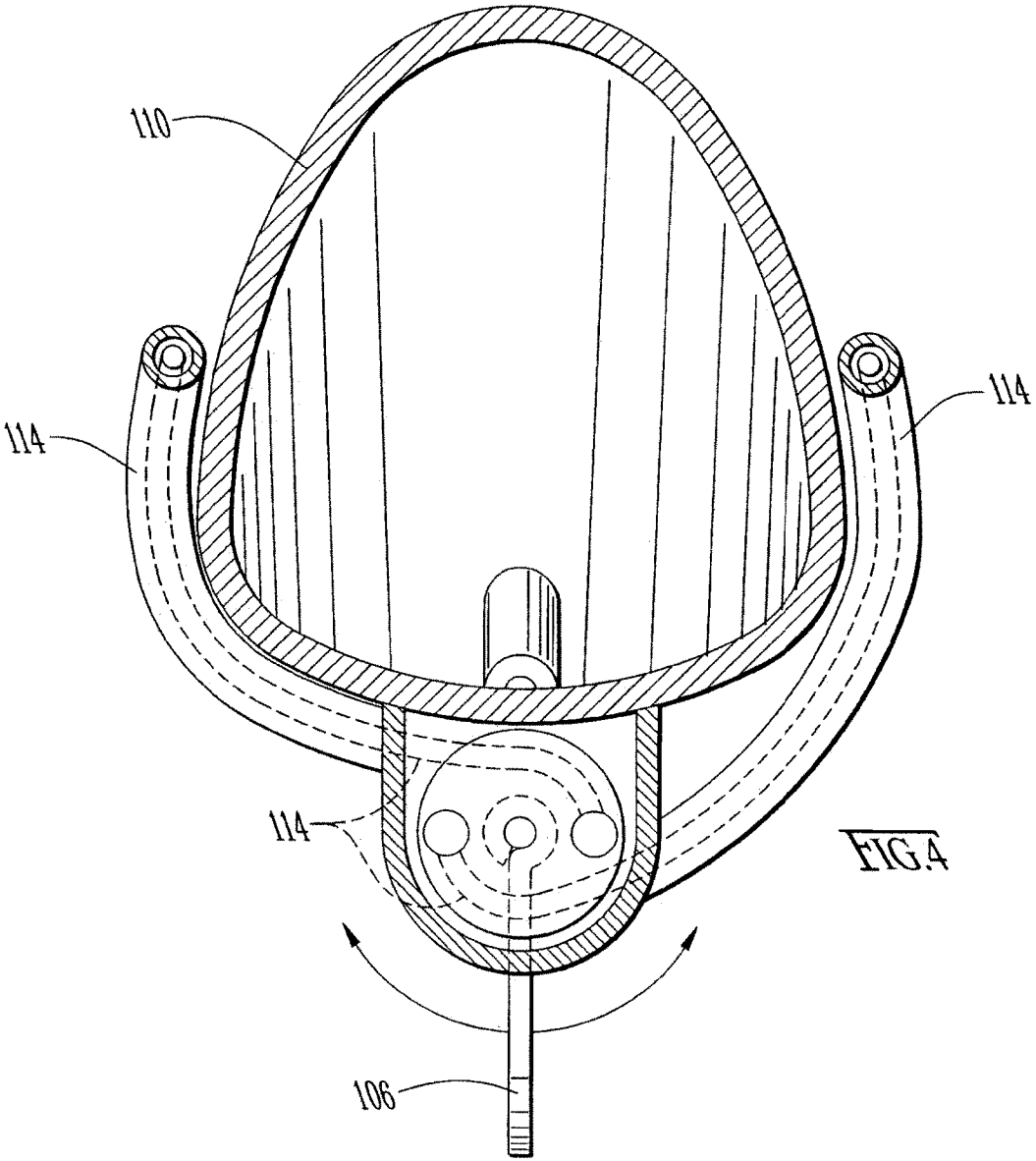
FIG. 4 is an enlarged scale sectional view taken along line IV-IV shown in FIG. 3.

FIGS. 1-3 show a clamp band 112 encircling the snorkel tube 110 for mounting portions of the steering apparatus 100 in accordance with the invention. FIG. 4 shows a Bowden cable system 114 for pivoting the miniature rudder 106.

FIG. 2, in the inset thereof, shows that the main steering wheel 50 of the inboard drive sports boat 40 might serve two purposes, both steering the main rudder 44 and the miniature rudder 106. The miniature rudder 106 is disabled and left straight until enabled by the user. The miniature rudder 106 could be automatically disabled above a given threshold forward speed (or reverse) and automatically returned to straight ahead. Or, the main steering wheel 50 could have a control provision 70 that triggers at a given threshold speed where, above the speed, the miniature rudder 106 is disabled and locked in straight ahead alignment, lower than the threshold speed and the miniature rudder 106 is automatically engaged. The drawing shows the threshold speed to be five mph (~eight kph) for example and without limitation.

It is an aspect of the invention to provide an automated outer control system 70 for the above described controls. The inner control system would be the user (ie., the driver), once the outer control system 70 enables the miniature rudder 106 steering control to be available to the user (driver) again. The outer control system 70 could replace all the speed inputs mentioned above with engine RPM's.

The main rudder 44 can always turn in tandem with the miniature rudder 106 at slow speeds without detracting from the work of the miniature rudder 106. In any event, at slow speeds, the main rudder 44 is next to worthless.

Figure 18:
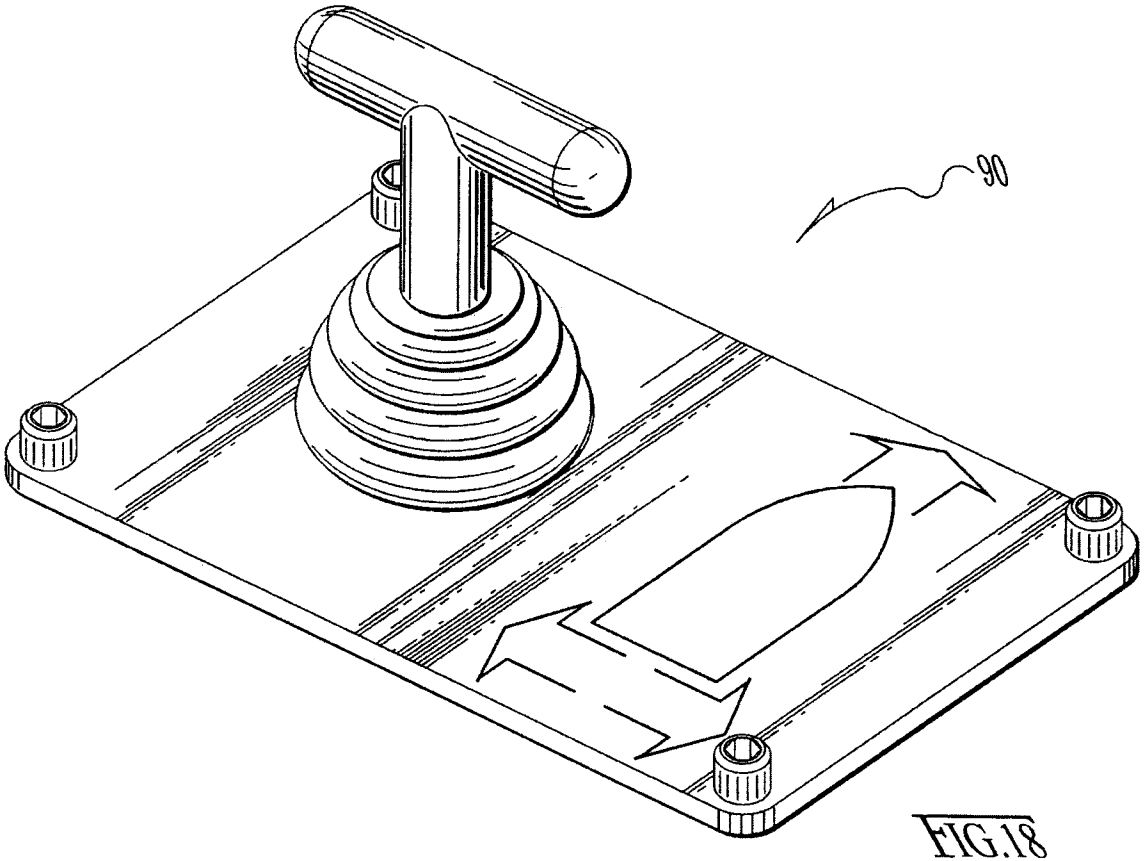
FIG. 18 is a perspective view of a manual joy-stick control (or toggle or switch or plurality of switches or the like) in accordance with the invention mounted in the helm in the boat and allowing a user to control any of the embodiments of the auxiliary low-speed marine steering apparatus in accordance with invention for mounting on, for mounting to, or for associating with inverted snorkel apparatus that submerges engine exhaust gases symmetrically (or so) with the centerline of the prop.

FIG. 18 shows an alternative user control apparatus 90, comprising a joy stick.

II

FIGS. 5-10 show a second embodiment of auxiliary low-speed marine steering apparatus 200 in accordance with the invention for inverted snorkel apparatus 202 that submerges engine exhaust gases symmetrically (or so) with the centerline of the prop 42.

Figure 5:
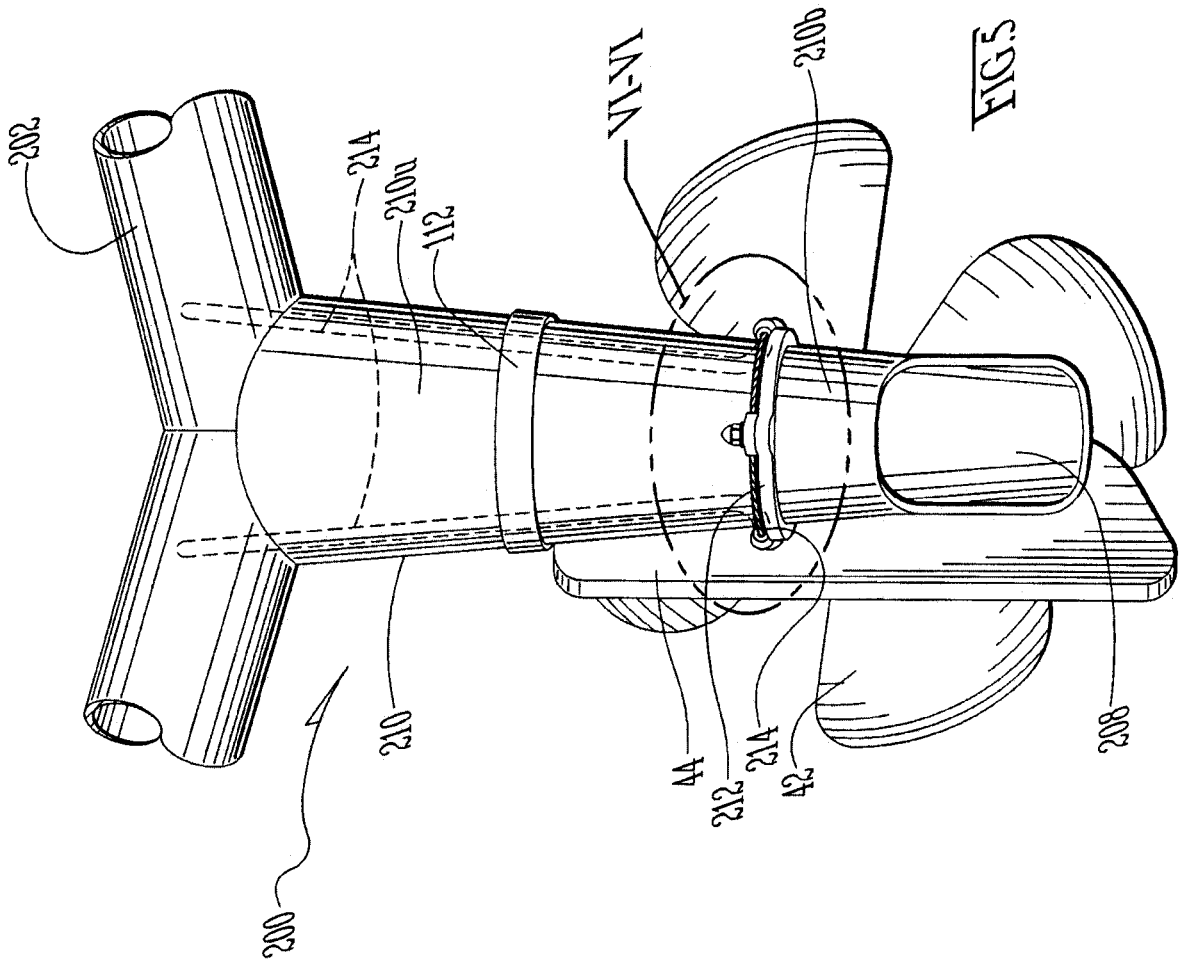
FIG. 5 is an end elevational view comparable to FIG. 1 except showing a second embodiment of auxiliary low-speed marine steering apparatus in accordance with the invention for inverted snorkel apparatus that submerges engine exhaust gases symmetrically (or so) with the centerline of the prop.
Figure 6:
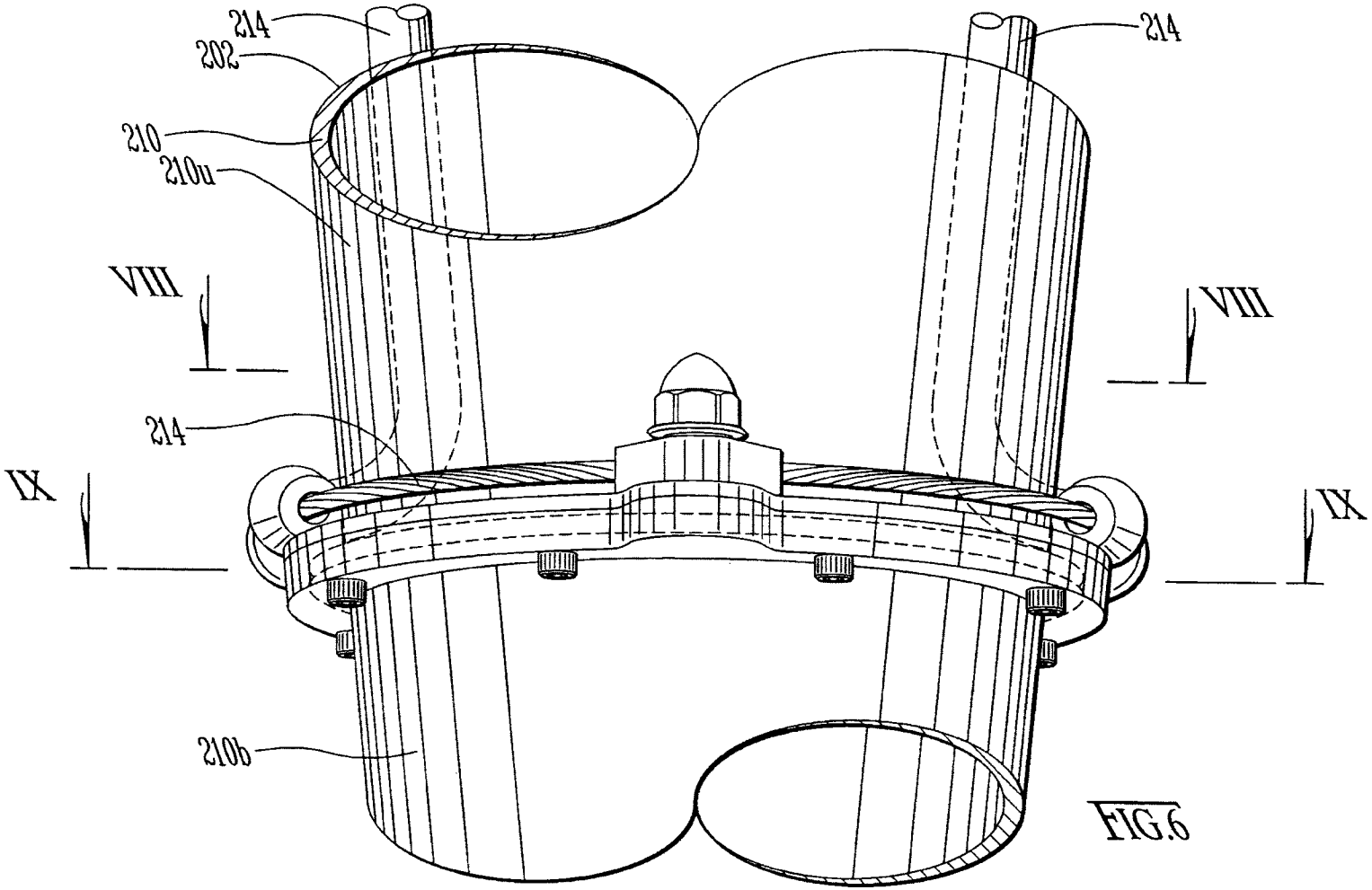
FIG. 6 is an enlarged-scale end elevational view of detail VI-VI shown in FIG. 5.
Figure 7:
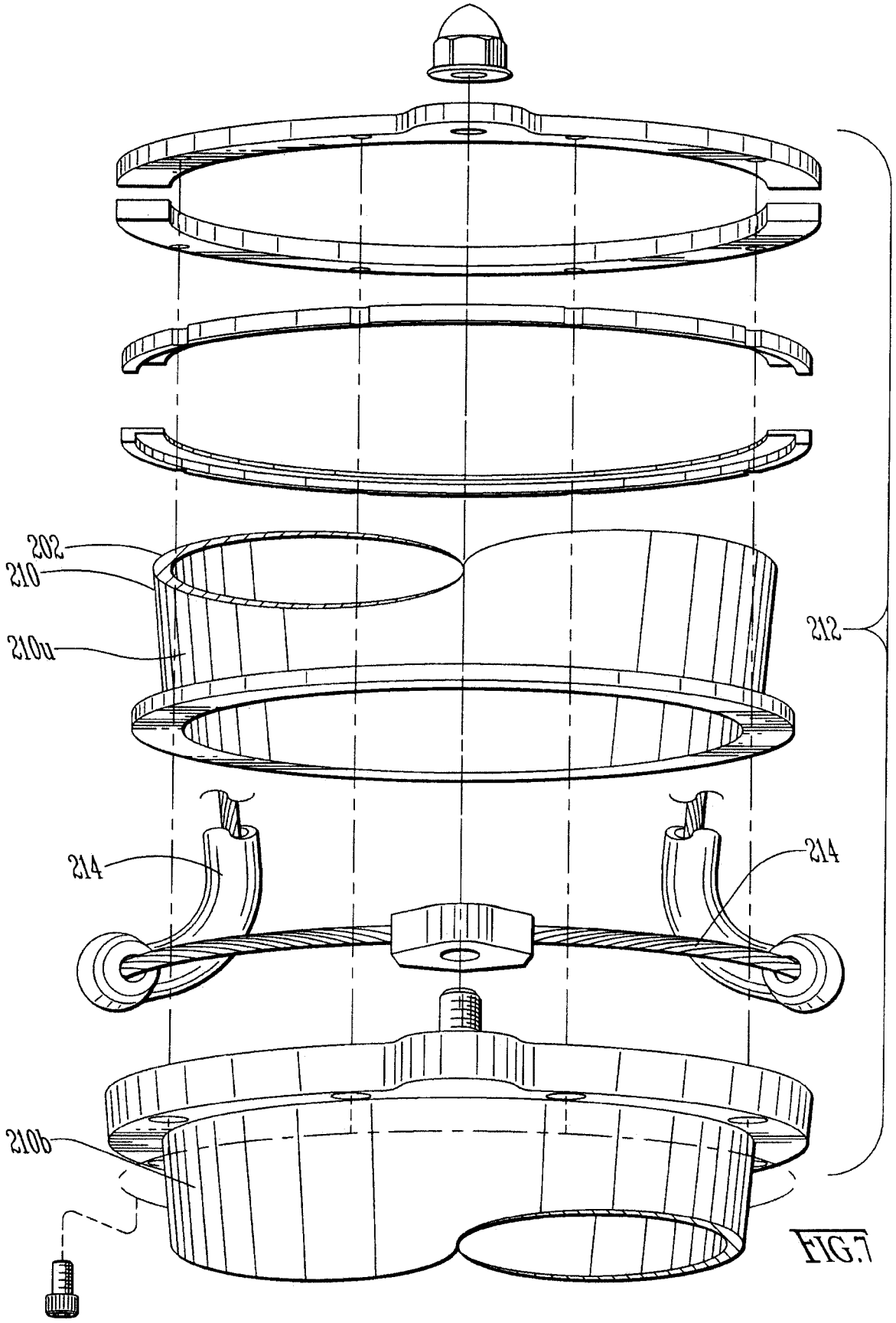
FIG. 7 is an exploded end elevational view of FIG. 6.
Figure 8:
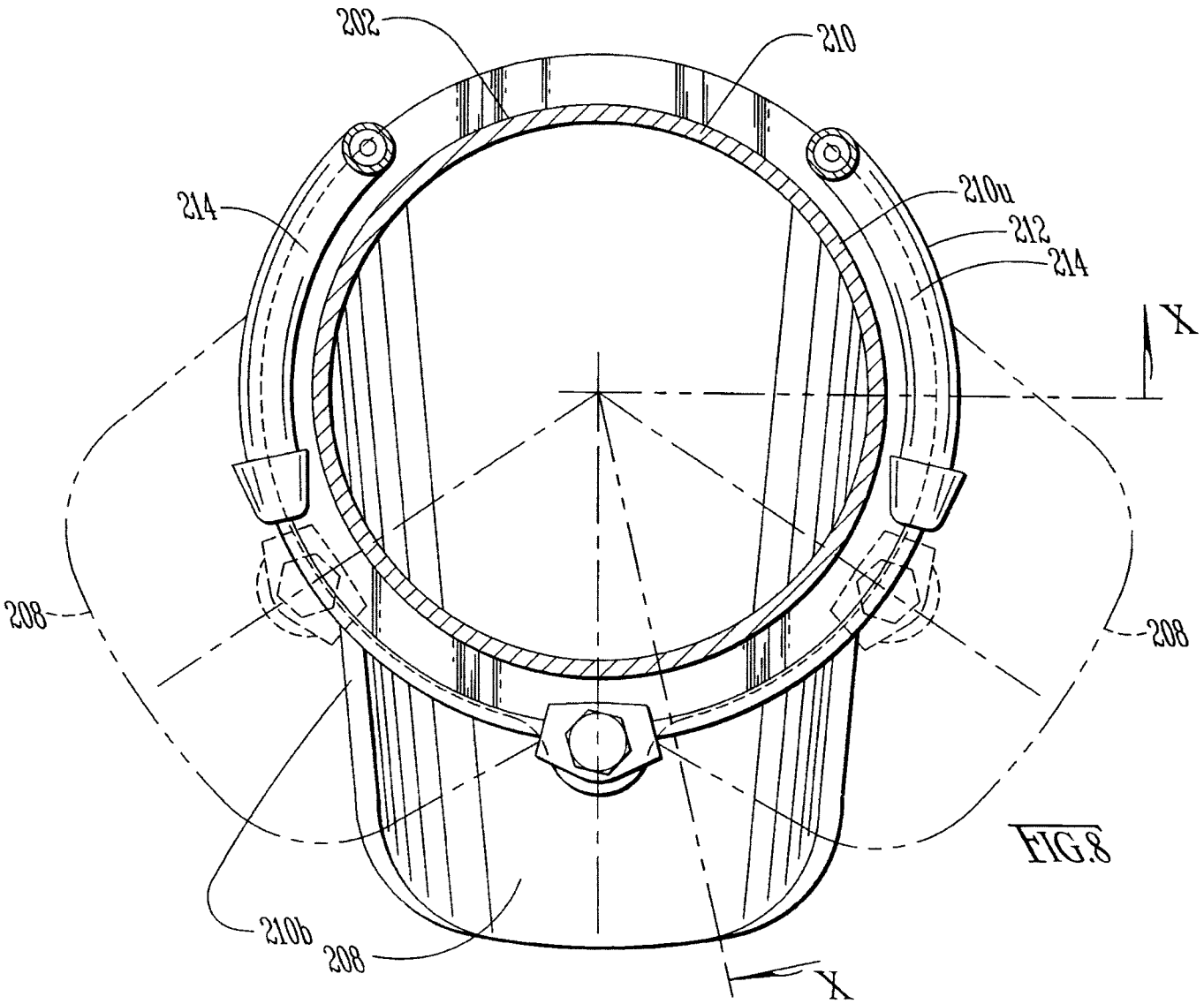
FIG. 8 is an enlarged scale sectional view taken along line VIII-VIII shown in FIG. 6.
Figure 9:
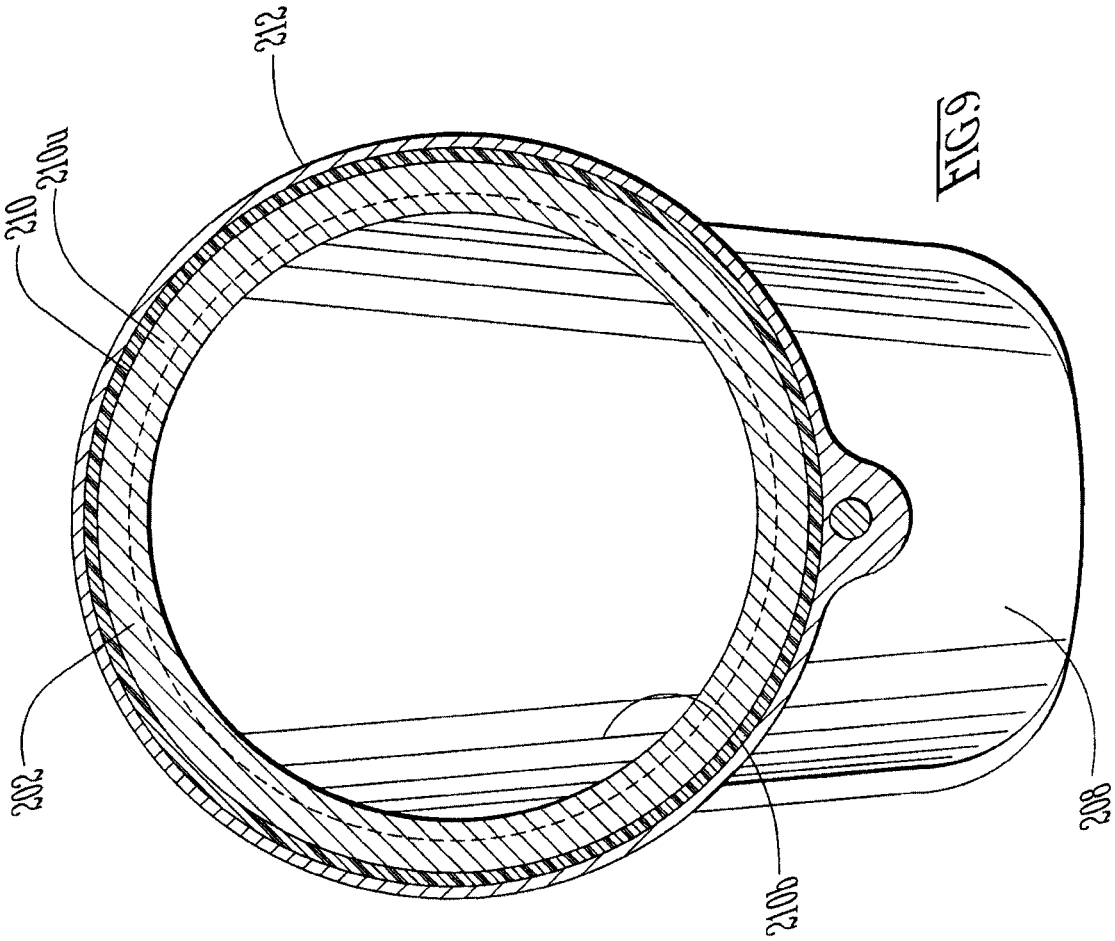
FIG. 9 is an enlarged scale sectional view taken along line IX-IX shown in FIG. 6.
Figure 10:
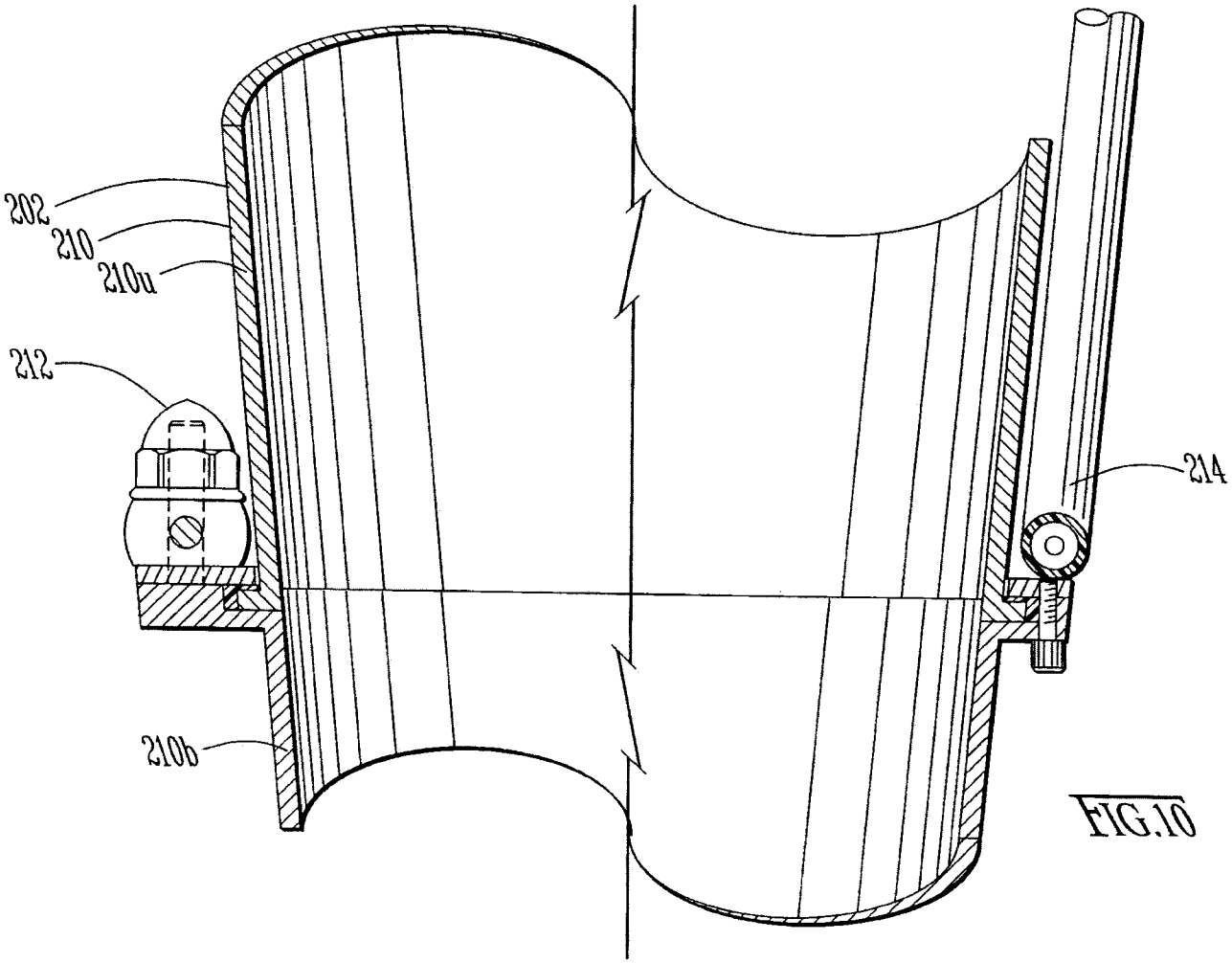
FIG. 10 is an enlarged scale sectional view taken along offset line X-X shown in FIG. 8.

FIGS. 5-7 show how the snorkel tube 210 partitioned in two 210*u* and 210*b*, and re-joined by a pivotal drive assembly 212, like an inverted submarine's periscope.

In this embodiment, everything 210*b* below the partition elevation 212 (as better shown in FIG. 7) can pivot left and right, pivoting the terminal outlet 208 of the inverted snorkel 202 left or right, and thereby provide port-side thrust vectoring or starboard-side thrust vectoring, respectively, of the engine exhaust gases.

The pivotal snorkel terminal outlet 210*b*/208 would be controlled by a Bowden cable system 214 similar to as before. The pivotal snorkel 210*b*/208 operability could likewise be controlled by the automatic outer control system 70 to render the pivotal snorkel 210*b*/208 operability inoperable above threshold set points and fixes the pivotal snorkel terminal outlet 210*b*/208 to straight ahead, and not return the possibility of user control until after conditions drop below the threshold set points.

III

Figure 11:
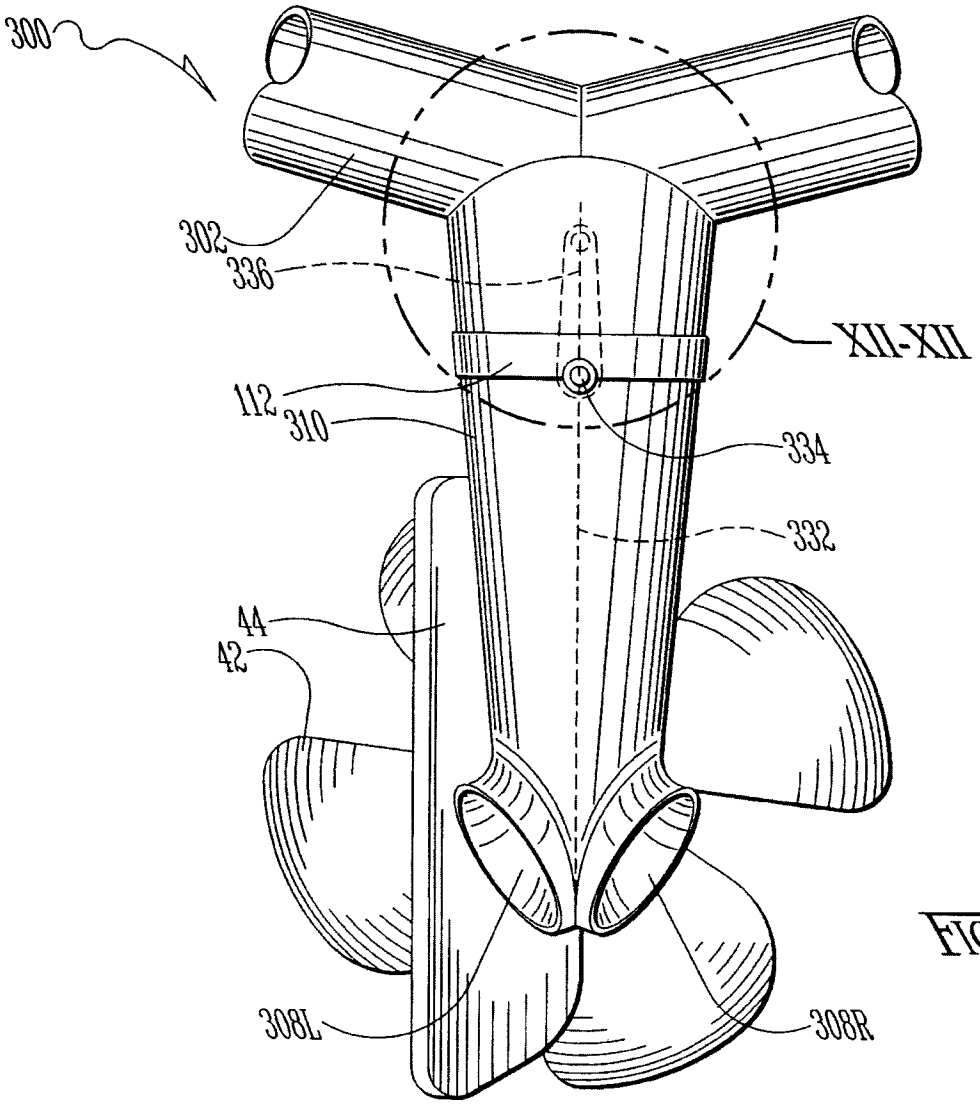
FIG. 11 is an end elevational view comparable to FIGS. 1 and 5 except of a third embodiment of auxiliary low-speed marine steering apparatus in accordance with the invention for inverted snorkel apparatus that submerges engine exhaust gases symmetrically (or so) with the centerline of the prop.
Figure 12:
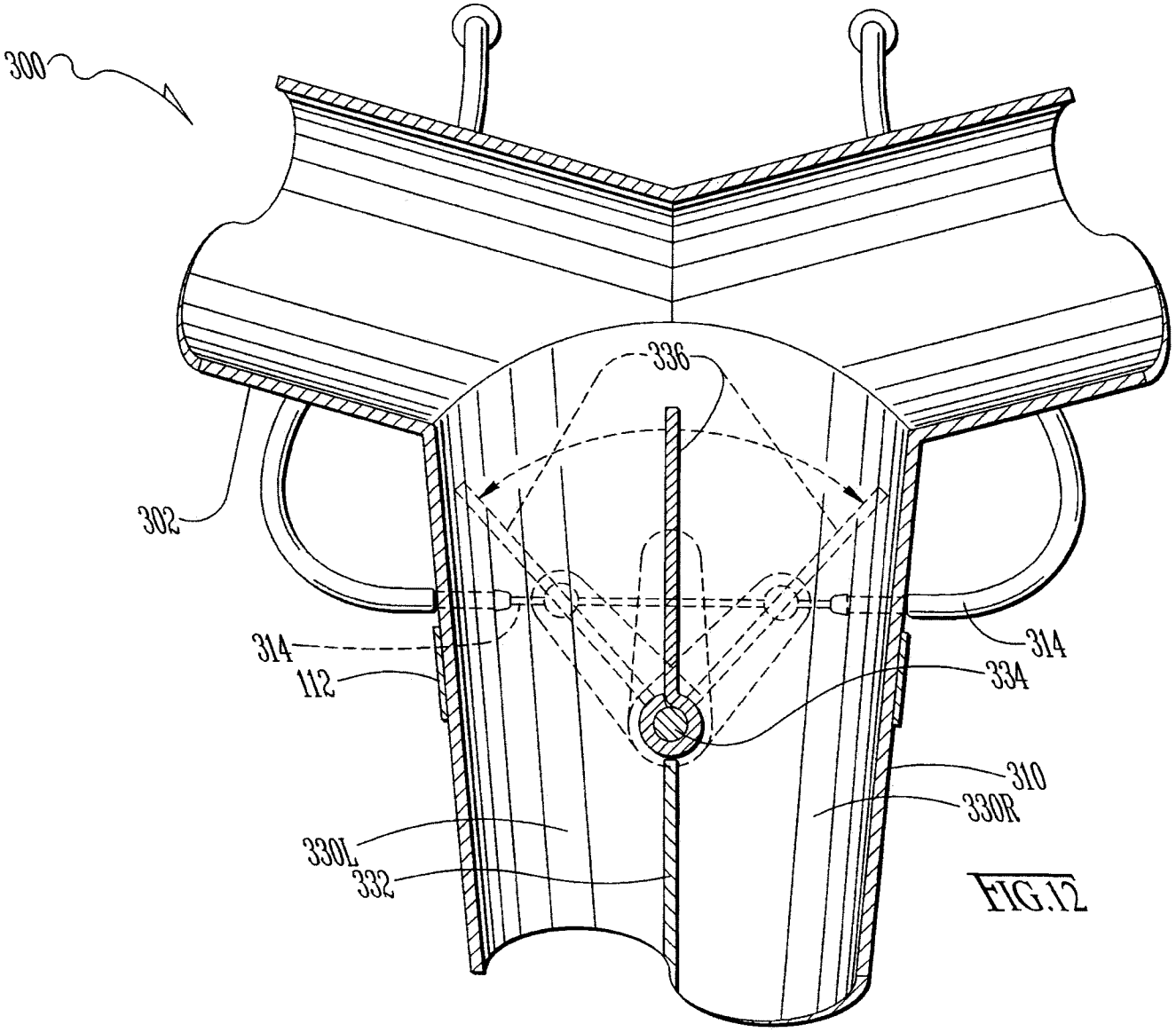
FIG. 12 is an enlarged scale sectional view taken within the detail indicated by circle XII-XII shown in FIG. 11.
Figure 13:
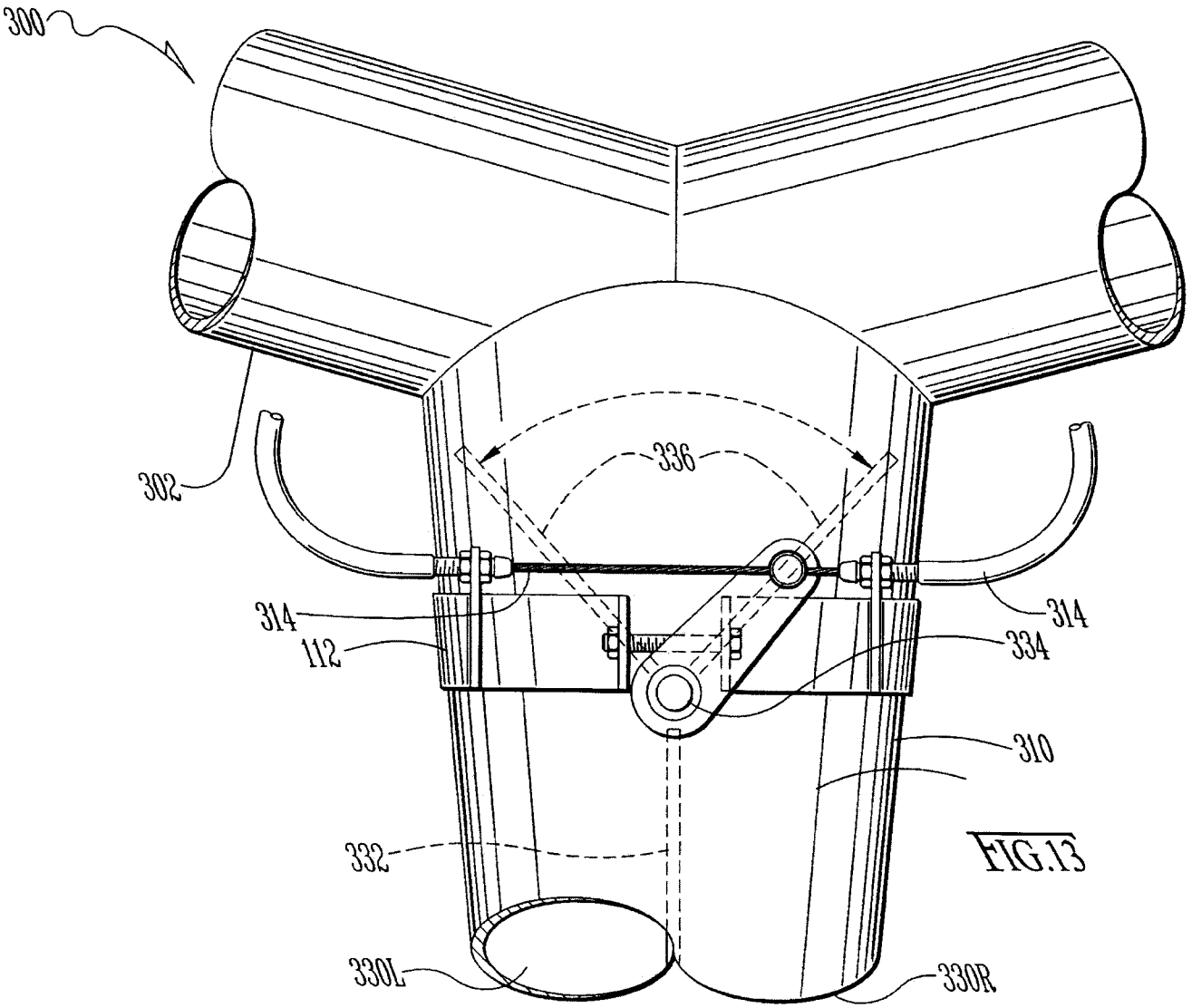
FIG. 13 is an enlarged-scale end elevational view comparable to FIG. 11, except from a perspective 180° apart in a horizontal plane (ie., not from a rear vantage point spaced back away from the prop and the transom of the water vessel and where the rear vantage point is aimed looking forward, but, instead, from a spaced apart swung-around forward vantage point that is looking rearward), and generally enlarged to within the detail indicated by circle XII-XII shown in FIG. 11.

FIGS. 11-13 show a third embodiment of auxiliary low-speed marine steering apparatus 300 in accordance with the invention for inverted snorkel apparatus 302 that submerges engine exhaust gases symmetrically (or so) with the centerline of the prop 42.

Here the outlet 308L, 308L of the snorkel tube column 310 is bifurcated with a pair of fixed ports 308L and 308R, one port 308L angled to provide a leftward thrust vector, the other port 308R for an opposite rightward thrust vector (left is port, right is starboard).

Inside the snorkel tube column 310, the majority of the elevation of the lumen 330 is partitioned by a (generally) vertical central wall 332, partitioning the snorkel tube column 310 into first and second columnar conduits 330L and 330R, each which terminates in one or the other of the outlet ports 308L and 308R respectively.

At the top edge 334 of the central vertical wall 332, a valve flap 336 (or damper plate) is pivotally connected to shut off flow of exhaust gases to one or the other conduits 330L or 330R (and corresponding one or the other outlet ports 308L or 308R). Toggling the valve 336 from one side to the other provides the corresponding control over changing the direction of the overall thrust vector.

Again, manual control (see eg., 50 in FIG. 2 or 90 in FIG. 14) would be enabled by a Bowden cable system 314 similar to as before.

And again, the operability of the valve flap 336 (damper plate) could likewise be controlled by the automatic outer control system (see eg., 70 in FIG. 2) to render the valve flap 336 (damper plate) inoperable above threshold set points and fixes the valve flap 336 (damper plate) to symmetric flow distribution, and not return the possibility of user control until after conditions drop below the threshold set points.

IV

Figure 15:
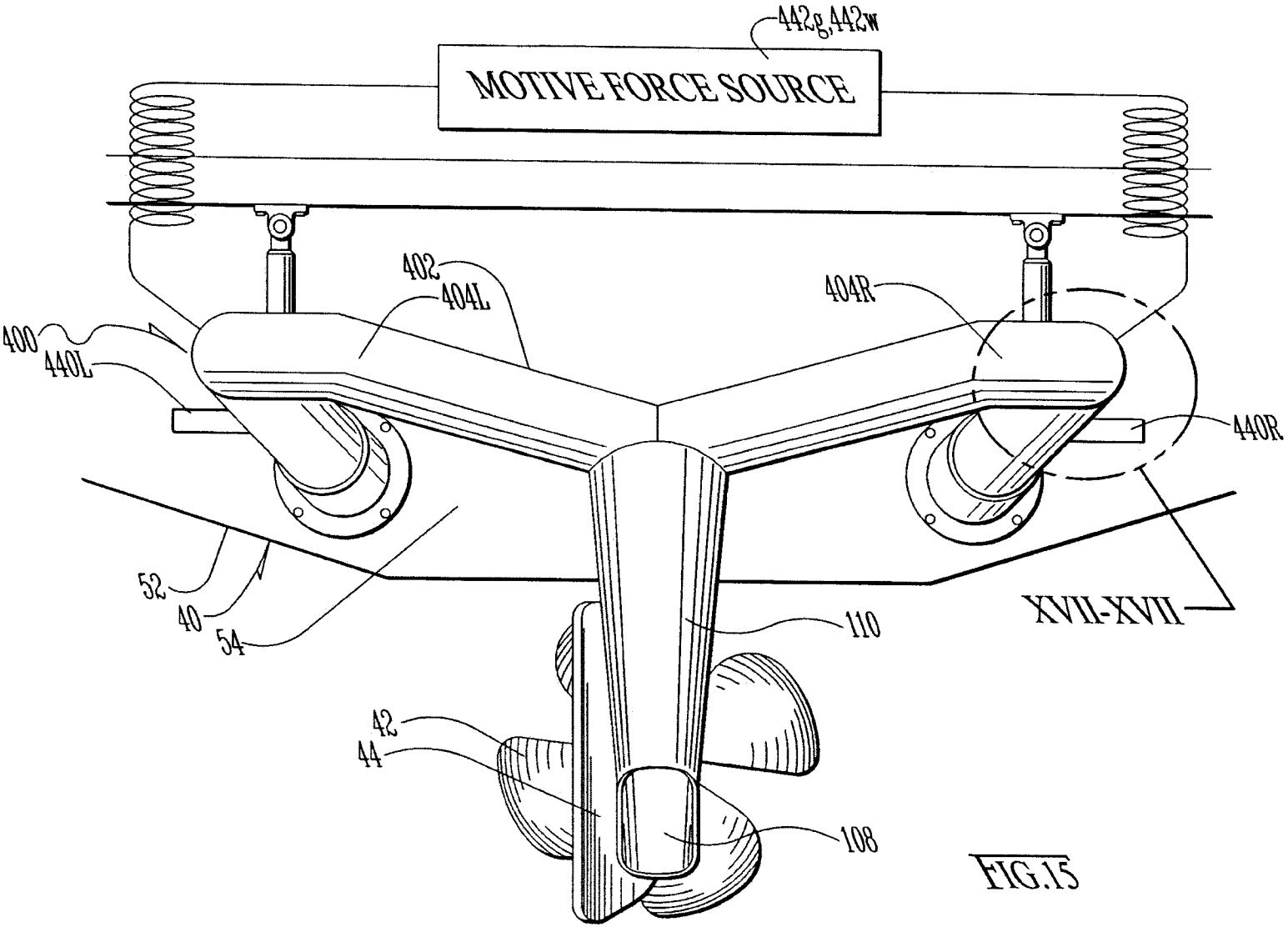
FIG. 15 is an end elevational view comparable to FIGS. 1, 5 and 11 except showing a fourth embodiment of auxiliary low-speed marine steering apparatus in accordance with the invention for inverted snorkel apparatus that submerges engine exhaust gases symmetrically (or so) with the centerline of the prop.
Figure 17:
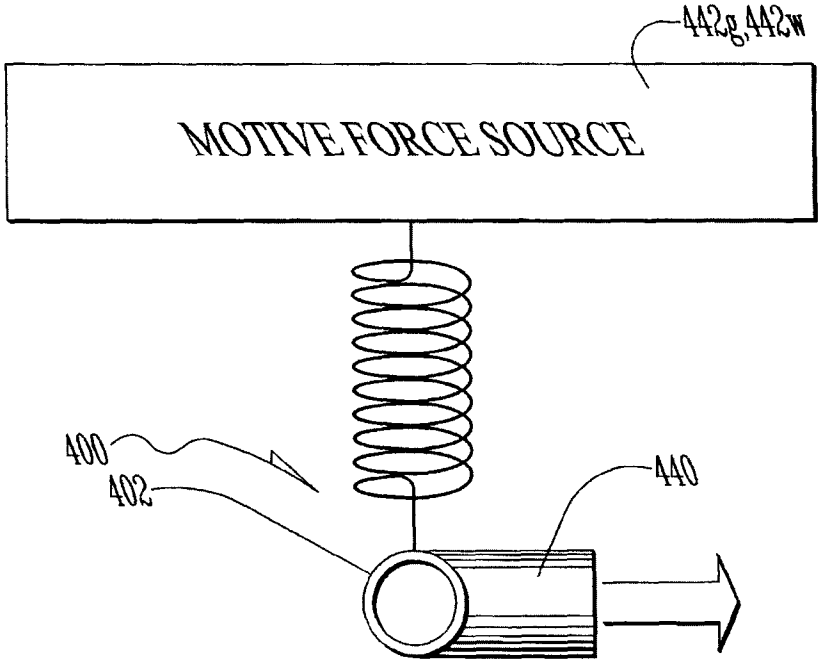
FIG. 17 is an enlarged scale end elevational view, partly in block diagram format, of detail XVII-XVII shown in either FIG. 15 or FIG. 16.

FIGS. 15 and 17 show a fourth embodiment of auxiliary low-speed marine steering apparatus 400 in accordance with the invention for inverted snorkel apparatus 402 that submerges engine exhaust gases symmetrically (or so) with the centerline of the prop 42.

With the next two embodiments, the working fluid used for providing the steering thrust can be either a gas (eg., pressurized air) or a liquid (eg., condensate water, lake water).

FIG. 15 shows that the exhaust tubes 404R and 404L of the inverted snorkel apparatus 402 can be utilized as 'ground' structures to mount oppositely aimed thrust nozzles 440L and 440R. FIG. 17, partly in block diagram format, shows one the two nozzles (eg., 440) on an enlarged scale.

Given the elevation of the location the nozzles 440L and 440R, when the inboard drive sports boat 40 is underway at cruising speeds, the nozzles 440L and 440R are not being dragged in the water but are above the surface of the water that is sheeting from underneath the hull 52 of the inboard drive sports boat 40 past the transom 54.

The motive force source 442*g*, 442*w* can be either pressurized air 442*g*, or, pumped water 442*w*, and so on. On a typical wake boat 40 in particular, there are plenty of water pumps onboard which could be readily enlisted into service as the source of the motive force. One such candidate is any of the ballast pumps. Many inboard drive sports boats 40 also carry a weak source of pressurized air, principally for inflating towables. But either could be plumbed into the steering system 400 in accordance with the invention.

Once more, the operability of the flow of the motive force fluid could be controlled by the automatic outer control system (see eg., 70 in FIG. 2) to render the operability of the flow of the motive force fluid inoperable above threshold set points, and not return the possibility of user control until after conditions drop below the threshold set points.

FIG. 18 shows an optional alternative for a user control apparatus 70, comprising a joy stick 70. That is, at first the gas source 442*g* or condensate source 442*w* are turned ON. Initially, the two opposite side thrust nozzles 440L and 440R will provide opposing and equal side thrusts, causing no steering effect all. But control of the joy stick 70 could choke the flow to one side (eg., 440R), thereby shunting all the flow to other side (440R), and thereby cause a steering effect.

FIG. 17 also provides the suggestion that adequate effectiveness of the auxiliary low-speed marine steering 400 in accordance with the invention could be adequately met with a single nozzle 440.

That is, inboard drive boats 40 are notoriously associated with a characteristic that is called "side thrust." The rotation of the prop 42 tends to add a steering component to inboard drive sports boat 40. Almost all inboard drive sport boats 40 have one or more technologies deployed to combat side thrust. That is, most inboard sport boats 40 have a series of tracking fins centered on their keel in the middle of the inboard drive sports boat 40. Also, the main rudder 44 is likely to have features which throw a little side-vectoring thrust to counter the prop-induced side thrust.

The inventor hereof is most familiar with older model NAUTIQUE® inboard drive boats 40 made by the CORRECT CRAFT® company of Orlando, Fla. Those boats 40 props 42 turned in the opposite direction relative to about every other competitor in the industry. That is because, another side effect of side thrust is that it tends to list the inboard drive sports boat 40 a little bit, dipping one gunwale down a little bit, and raising the opposite side gunwale up a little bit.

For an inboard drive competition slalom-ski boat 40, CORRECT CRAFT® chose the prop rotation direction to be the one which the starboard gunwale would rise. This is also the side of the inboard drive competition slalom-ski boat 40 in which the helm 48 is laid out. So the idea was, in competition, there would be a single passenger being the driver, sitting at the helm 48. There would be no other passenger, like a spotter. Slalom runs are short anyway, and even without the rearview mirror, the driver can sense through such inboard drive competition slalom-ski boat 40 when the rider has fallen.

But to get back to the idea of which direction to choose for prop rotation, it was chosen to be direction where the driver's weight in the starboard side of the inboard drive competition slalom-ski boat 40 would counter the rise of the side thrust, rather than add to it.

To get back to the effects of side thrust at slow speeds, an inboard drive sports boat 40's heading can be influenced by bumping the prop 42 into and out of gear. The side thrust causes the transom 54 to shift to one side or the other, which also causes the inboard drive sports boat 40 as a whole to point to heading in the opposite direction.

For example, with the inventor's older NAUTIQUE® inboard drive sports boat 40, the side thrust caused by bumping the prop 42 into and out of gear in the forward direction causes the transom 54 to shift starboard, and hence slide the boat 40 from pointing straight ahead but a little to the port.

In the rearward direction, the opposite happens, the side thrust caused by bumping the prop 42 into and out of gear going in the rearward direction causes the transom 54 to shift port, and hence slide the boat 40 from pointing straight ahead but a little to the starboard.

Backing off of the bunks of a boat slip in the inventor's inboard drive sports boat 40 has the rear port corner of the hull 52 always seeking to collide with the left-side walkway of the boat slip. A boat bumper provides the temporary protection for this moment. But this also makes for wonderful maneuvering at the fuel dock. That is, undertake the maneuver of approaching the fuel dock at a forty-five degree angle real slow with the port side oriented to come in and lie along the fuel dock. Goose the prop 42 pretty hard in reverse and then shut the engine OFF. The inventor's inboard drive sports boat 40 will come to a stop and pivot parallel to the fuel dock.

But parking an inboard drive sports boat 40 back into the slip is where the side thrust issues are the worst. The inventor's inboard drive sports boat 40 has to be steered into its slip after making a ninety degree turn having been driving down a lane of slips in the marina. That ninety degree turn at slow speed tends to put the boat 40 in a slow spin merely because of the momentum of the boat 40 due to its weight. That's when the main rudder 44 is most pitiful at helping overcome that slow drift. Bumping the boat 40 into and out of gear real quick can sometimes put side thrust artfully to use.

But the timing of that is harder to catch every time than at the fuel dock.

In sum, perhaps all the amount of auxiliary low-speed marine steering 400 in accordance with the invention that is really needed is only a little jet 440 on one side of the inverted snorkel 402.

FIG. 17 shows just that. One little jet 440 on the starboard side (and none on the port side) would solve many issues for return parking in the boat slip for an inboard drive sports boat 40 which prop 42 spins in the direction of the older NAUTIQUES®. Correspondingly, one little jet 440 on the port side (and none on the starboard side) would solve those issues for return parking in the boat slip for the inboard drive sports boats 40 which props 42 spin in the counter-rotational direction.

V

Figure 16:
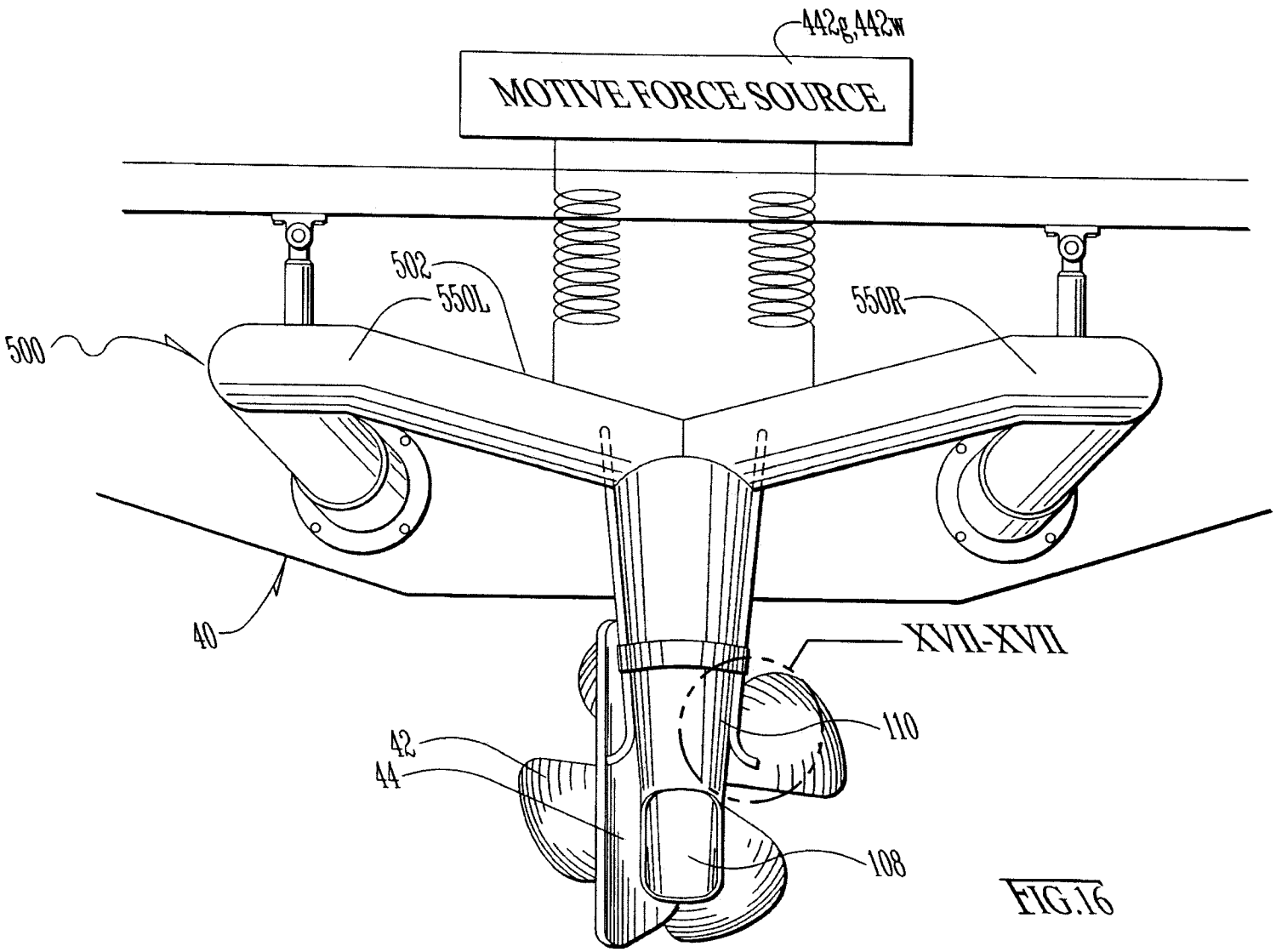
FIG. 16 is an end elevational view comparable to FIGS. 1, 5, 11 and 15 except showing a fifth embodiment of auxiliary low-speed marine steering apparatus in accordance with the invention for inverted snorkel apparatus that submerges engine exhaust gases symmetrically (or so) with the centerline of the prop.

FIG. 16 shows a fifth embodiment of auxiliary low-speed marine steering apparatus 500 in accordance with the invention for inverted snorkel apparatus 502 that submerges engine exhaust gases symmetrically (or so) with the centerline of the prop 42.

This embodiment 500 is comparable to the FIG. 15 version except the location of the mounting of the opposite side thrust nozzles 550L and 550R has been moved to the main down tube 110 of the inverted snorkel 502. Otherwise, the FIG. 16 version works similarly and provides similar effects as the FIG. 15 version.

Again, the motive force 442*g*, 442*w* source can be either pressurized air, or, pumped water, and so on. On a typical wake boat 40 in particular, there are plenty of water pumps onboard which could be enlisted into service as the motive force source. One such candidate is any of the ballast pumps. Many inboard drive sports boats 40 also carry a weak source of pressurized air, principally for inflating towables. But either could be plumbed into the steering system in accordance with the invention.

FIG. 18 shows an optional alternative for a user control apparatus 70, comprising a joy stick 40. That is, at first the gas source 442*g* or condensate source 442*w* are turned ON. Initially, the two opposite side thrust nozzles 550L and 550R will provide opposing and equal side thrusts, causing no steering effect all. But control of the joy stick 70 could choke the flow to one side (eg., 550L), thereby shunting all the flow to other side (550R), and thereby cause a steering effect.

VI

Figure 19:
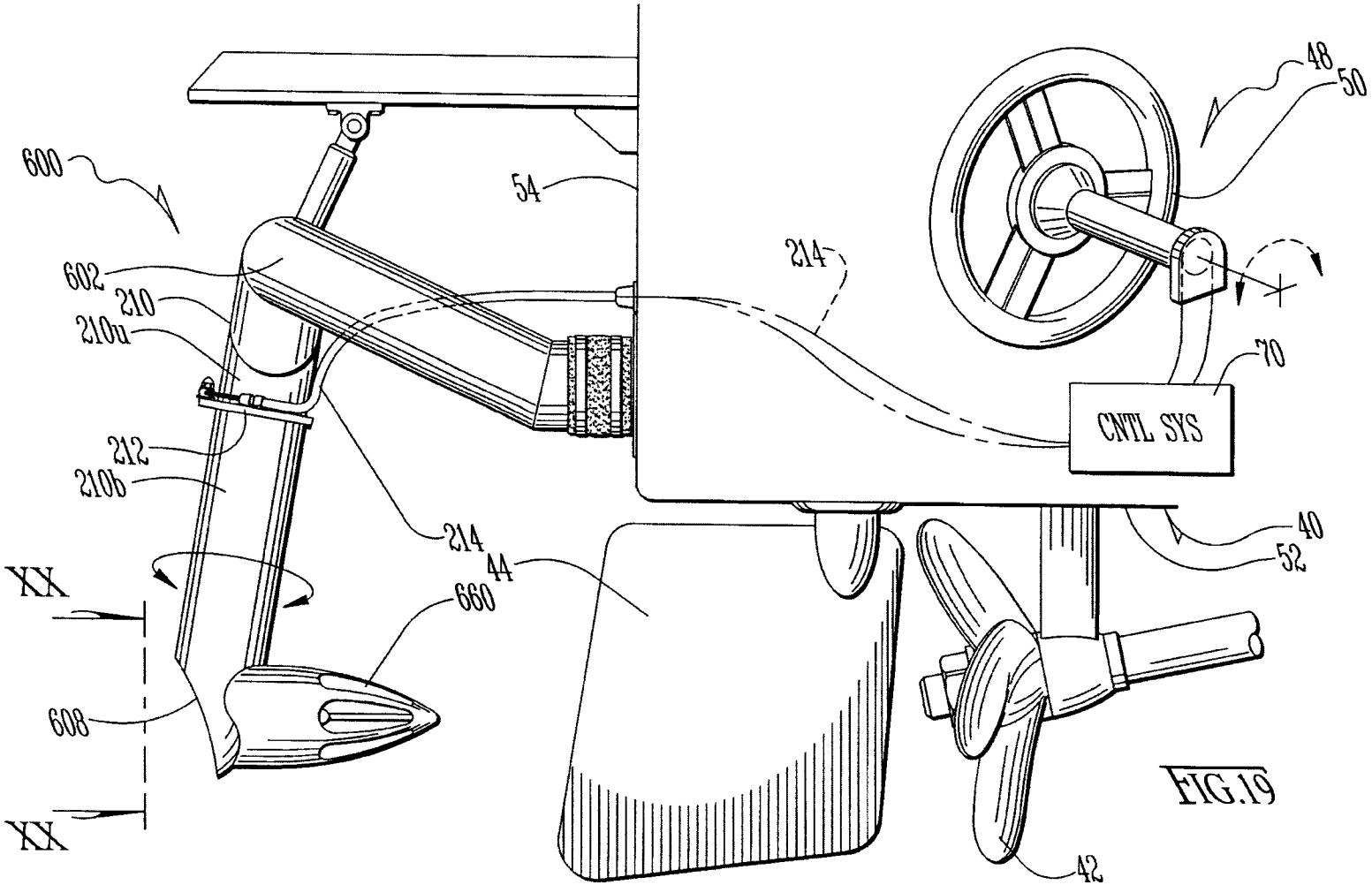
FIG. 19 is a side elevational view comparable to FIG. 2, except showing a sixth embodiment of auxiliary low-speed marine steering apparatus in accordance with the invention for inverted snorkel apparatus that submerges engine exhaust gases symmetrically (or so) with the centerline of the prop.
Figure 20:
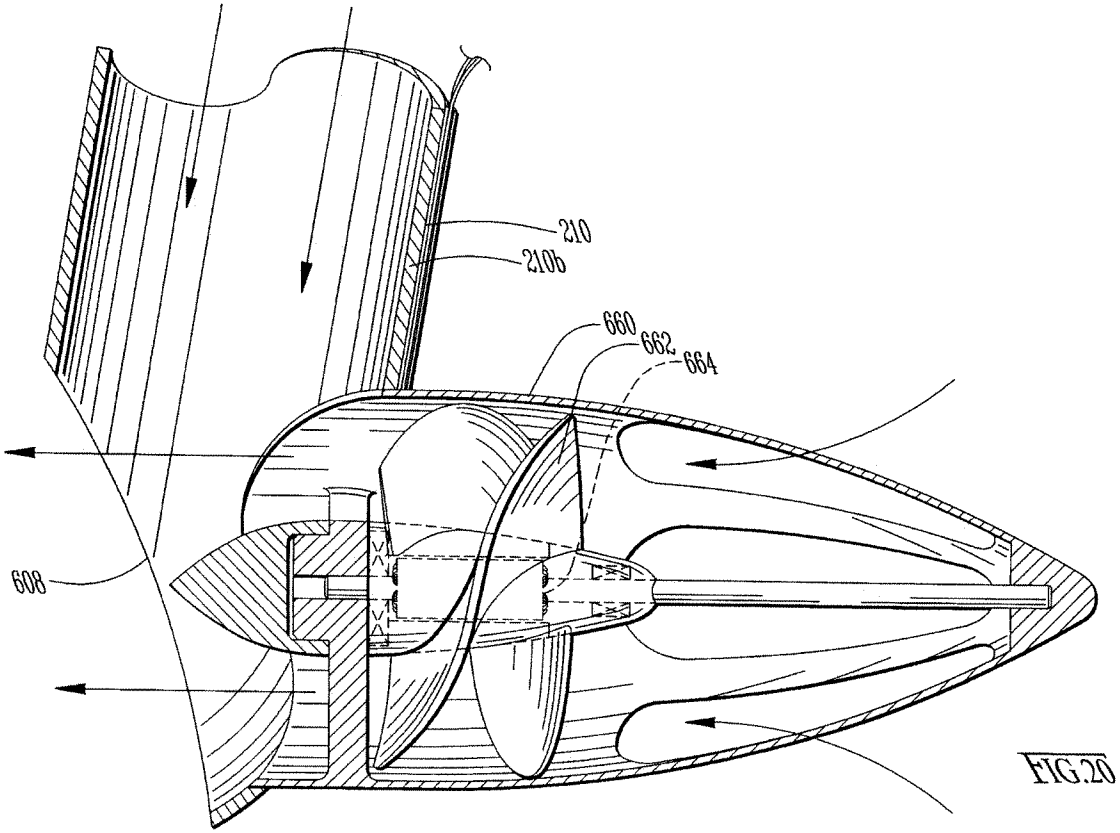
FIG. 20 is a partial sectional view taken along line XX-XX in FIG. 19, showing an electric powered prop comparable to a trolling motor prop within a bulbous bulb housing therefor combined with the inverted snorkel apparatus that submerges engine exhaust gases symmetrically (or so) with the centerline of the prop.
Figure 21:
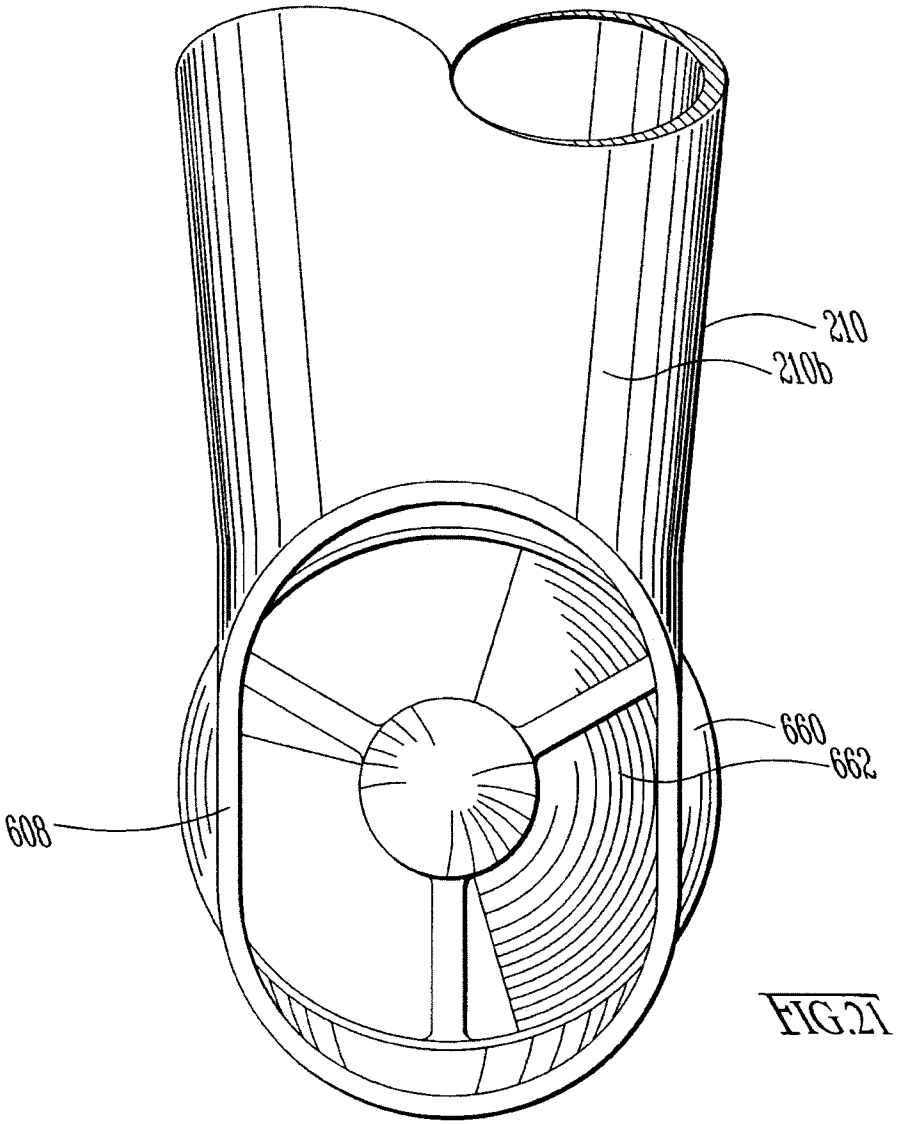
FIG. 21 is an end elevational view of FIG. 20.

FIGS. 19-21 show a sixth embodiment of auxiliary low-speed marine steering apparatus 600 in accordance with the invention for inverted snorkel apparatus 602 that submerges engine exhaust gases symmetrically (or so) with the centerline of the prop 42.

The terminal outlet 608 of the inverted snorkel 602 is formed to have a forward-jutting bulbous bow 660, like seen on the hull of ocean cargo ships. That forward-jutting bulbous bow 660 serves as a streamlined housing 660 for an electric powered prop 662 comparable to a trolling motor prop 662. The housing 660 is ventilated to admit inflow water.

The electric trolling-style motor 664 provides thrust. The terminal outlet 608 of the inverted snorkel 602 is controllably pivotal by a user in the same manner as described above in connection with FIGS. 5-10.

And for another time, the operability of the electric trolling-style motor 664 could likewise be controlled by the automatic outer control system 70 eg. to render electric trolling-style motor 664 inoperable above threshold set points and fixes the forward-jutting bulbous bow 660 to straight ahead, and not return the possibility of user control until after conditions drop below the threshold set points.

VII

Figure 22:
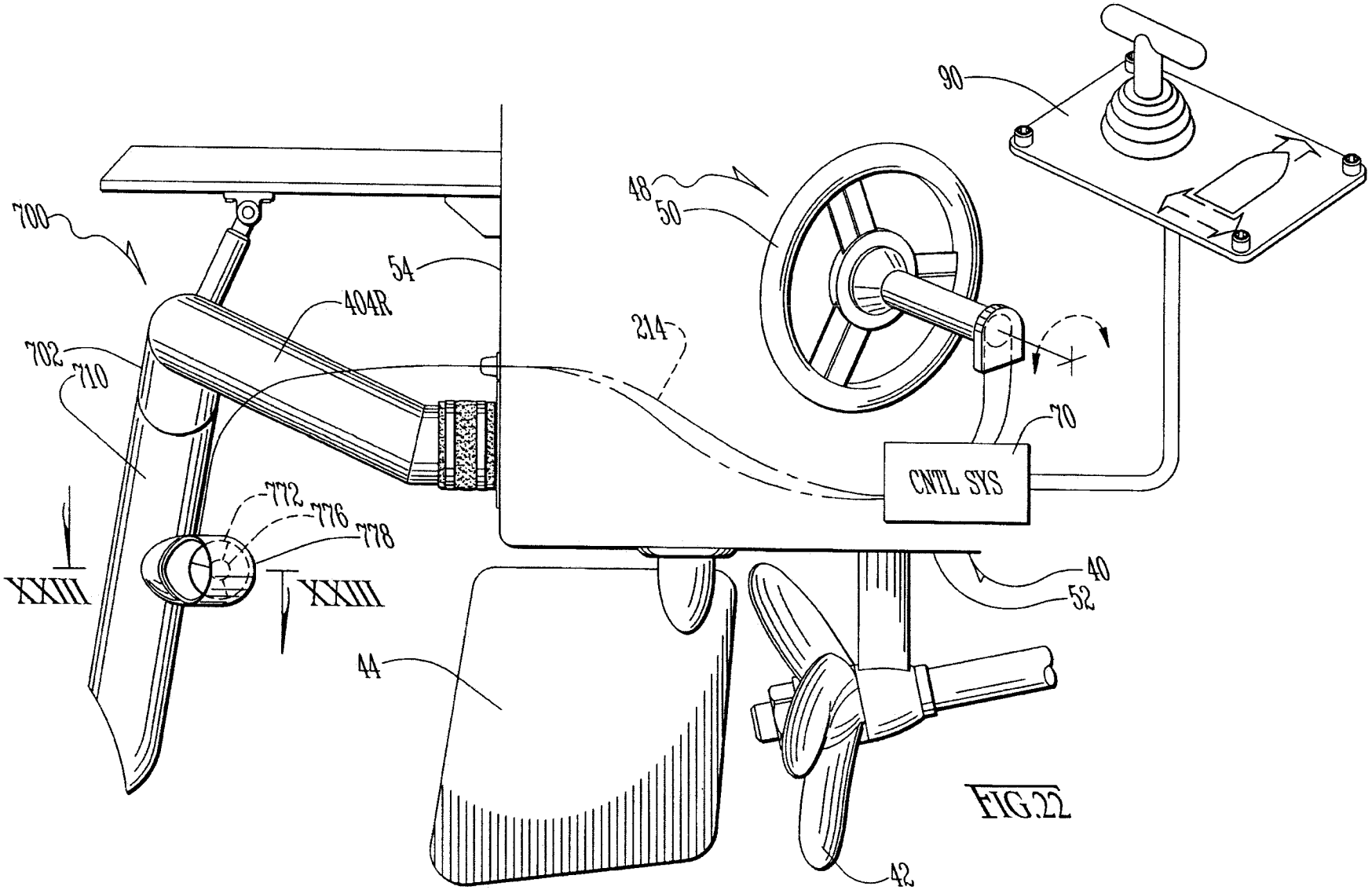
FIG. 22 is a side elevational view comparable to FIGS. 2 and 19, except showing a seventh embodiment of auxiliary low-speed marine steering apparatus in accordance with the invention for inverted snorkel apparatus that submerges engine exhaust gases symmetrically (or so) with the centerline of the prop.
Figure 23:
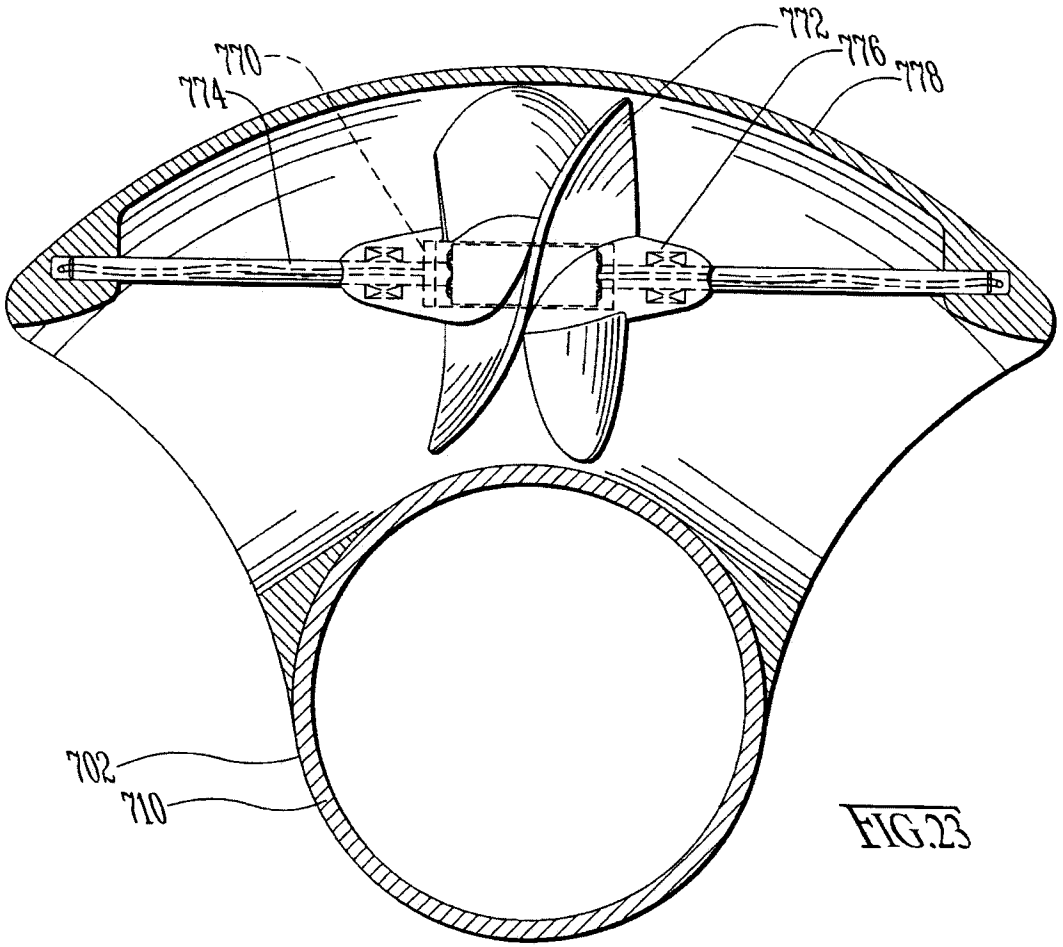
FIG. 23 is a partial sectional view taken along line XXIII-XXIII in FIG. 22, showing an electric-powered drum-motor powered prop comparable to a trolling motor prop within a housing therefor combined with the inverted snorkel apparatus that submerges engine exhaust gases symmetrically (or so) with the centerline of the prop.

FIGS. 22 and 23 show seventh embodiment of auxiliary low-speed marine steering apparatus 700 in accordance with the invention for inverted snorkel apparatus 702 that submerges engine exhaust gases symmetrically (or so) with the centerline of the prop 42.

Here, the snorkel tube column 710 of the inverted snorkel apparatus 702 provides a 'ground' structure for the crosswise mounting of a reversible electric motor 770 that drives a prop 772. More accurately, the electric motor 770 drives an auger 772 (ie., screw thread) like the jet drive of a PWC (personal water craft). The preference for the electric motor 770 is to use a drum motor in contrast to a standard motor configuration. Standard motors have their skin is mounted stationary and their central axle is a rotor which rotates. With drum motors, the central axle 774 is held stationary and the skin 776 (cylindrical casing) rotates. These are popular for conveyor belt drives (no conveyor belt is shown).

FIG. 23 shows better the electric-powered drum-motor 770. The electric-powered drum-motor 770 thus provides the power for turning its prop 772 (or again, auger). The electric-powered motor 770 is preferably implemented as a drum-motor because of space restrictions.

The electric-powered drum-motor 770 can be reversible and therefore provide thrust either port or starboard. However, as discussed in connection with FIG. 17, affording the user opportunity to have auxiliary thrust to one side only might be sufficient under the circumstances. Hence, a single direction (non-reversible) motor 770 would provide better advantages, of course, than none at all.

FIG. 22 shows that the main steering wheel 50 is permanently operatively coupled to the main rudder 44. The user interface 90 (user-machine interface which, as shown here, is a joystick or toggle) controls the auger motor 770 only.

As has been said many times before, the operability of the auger motor 770 could likewise be controlled by the automatic outer control system 70 to render the auger motor 770 inoperable above threshold set points, and not return the possibility of user control until after conditions drop below the threshold set points.

As in FIG. 15, the horizontal runs the exhaust tubes 404L and/or 404R of the inverted snorkel apparatus 702 can be utilized as 'ground' structures to mount on one side or the other the housing 778 of the auger 772 and the housing 778's drive motor 770 that the housing 778 wraps around (ie., electric-powered drum-motor 770). Again, as discussed in connection with FIG. 17, not only is auxiliary thrust to one side sufficient, but the auxiliary thrust need not come from the centerline of the inboard drive sports boat 40. And the auger 772 (ie., including its housing 778 and drive motor 770) can be located on the runs of the exhaust feeder tubes 404L and/or 404R of the inverted snorkel apparatus 702 (horizontal or otherwise, and single-sided as in FIG. 14 or otherwise), at elevations where—when the inboard drive sports boat 40 is on plane—the auger 772, housing 778 and drive motor 770 are all out of the water. But when the inboard drive sports boat 40 is idle or at no-wake speeds, the auger 772, housing 778 and drive motor 770 are submerged again.

VIII

It is an aspect of the invention that auxiliary low-speed marine steering in accordance with the invention as associated with an inverted snorkel for underwater engine exhaust, for most embodiments of the invention described above, does not replace the main steering and main power of the internal combustion engines.

Rather instead, auxiliary low-speed marine steering in accordance with the invention merely supplies gentle augmentation at slow speeds. The slower the speed, the more valuable is the help provided by the inventive auxiliary low-speed marine steering. The main power of the internal combustion engine pushes the inboard drive sports boat 40 forward if not in an uncertain direction and almost always with a flat spin involved. But in most embodiments of the invention, the inventive auxiliary low-speed marine steering provides a slight bump to one side or the other (again, being able to offer that bump consistently on one side is good enough for a lot of inboard drive sports boats 40).

The power that can be provided by main power of the internal combustion engine is never deficient. It's just that a slow speeds (just barely creeping along speeds), the inboard drive sports boat 40 cannot be steered very well. The inventive auxiliary low-speed marine steering provides its most valuable service under these circumstances. Moreover, it is an advantage of the invention to combine the inventive auxiliary low-speed marine steering with an inverted snorkel modified in accordance with the invention so that the two apparatus are bundled in a unitary product. By design it promotes complement and avoids interference. A single install puts the utility of both apparatus on a inboard drive sports boat 40 at once.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. An improvement for inboard motor boats comprising:

an inverted snorkel comprising a conduit for combustion gases exhaust extending outside the hull having an outlet aft of the transom; and an auxiliary source of thrust providing low-speed marine steering adjustments, said auxiliary source of thrust combined with the conduit for combustion gases exhaust extending outside the hull;

wherein the auxiliary source of thrust comprises a drum motor and an auger affixed external of the of the drum motor.

2. The improvement for inboard motor boats of claim 1, wherein:

the auxiliary source of thrust is electric powered.

3. The improvement for inboard motor boats of claim 1, wherein:

wherein the inverted snorkel's conduit comprises a terminal generally vertical tube column, whereby said tube column serves as a ground structure for the cross-wise mounting of drum motor;

said improvement for inboard motor boats further comprising a mount for the drum motor and auger for cross-wise affixation of the drum motor relative the generally vertical tube column.

4. The improvement for inboard motor boats of claim 3, wherein:

the mount comprises a generally horizontal conduit mounted on, mounted to, or associated with the generally vertical tube column whereby the generally horizontal conduit serves as a housing.

5. The improvement for inboard motor boats of claim 4, wherein:

the generally horizontal conduit wraps around the generally vertical tube column.

6. The improvement for inboard motor boats of claim 4, further comprising:

a controller in the helm of the boat operatively connected to the drum motor enabling ON and OFF operation of the drum motor, whereby providing thrust in at least one side direction.

7. The improvement for inboard motor boats of claim 6, wherein:

the controller is configured and operatively connected to the drum motor not only enabling ON and OFF operation of the drum motor but also ON operation in one direction and ON operation in a reverse direction, whereby providing thrust in either side direction.

8. The improvement for inboard motor boats of claim 2, further comprising:

a manually-operable controller in the helm of the boat operatively connected to electric-powered auxiliary source of thrust enabling ON and OFF operation of the auxiliary source of thrust; and an automatic outer control system to render the manually-operable controller inoperable above threshold set points, and thereby not return the possibility of user control until after conditions drop below the threshold set points.

9. An improvement for inboard motor boats comprising:

an inverted snorkel comprising a conduit for combustion gases exhaust extending outside the hull having an outlet aft of the transom; and an auxiliary source of thrust providing low-speed marine steering adjustments, said auxiliary source of thrust combined with the conduit for combustion gases exhaust extending outside the hull;

wherein the auxiliary source of thrust is electric powered; and wherein the inverted snorkel's conduit comprises one or more generally horizontal runs which singly or collectively terminate in and exhaust out through a terminal generally vertical run;

whereby at least one of the one or more generally horizontal runs serves as a ground structure for side-aimed mounting of the electric powered auxiliary source of thrust;

said improvement for inboard motor boats further comprising a mount for the electric powered auxiliary source of thrust for side-aimed affixation of the electric powered auxiliary source of thrust relative the at least one of the one or more generally horizontal runs.

10. The improvement for inboard motor boats of claim 9, further comprising:

a manually-operable controller in the helm of the boat operatively connected to the electric powered auxiliary source of thrust enabling ON and OFF operation of the electric powered auxiliary source of thrust, whereby providing thrust in at least one side direction.

11. The improvement for inboard motor boats of claim 10, further comprising:

an automatic outer control system to render the manually-operable controller inoperable above threshold set points, and thereby not return the possibility of user control until after conditions drop below the threshold set points.

12. The improvement for inboard motor boats of claim 10, wherein:

the auxiliary source of thrust comprises a drum motor and an auger affixed external of the of the drum motor.

13. The improvement for inboard motor boats of claim 12, wherein:

the controller is configured and operatively connected to the drum motor not only enabling ON and OFF operation of the drum motor but also ON operation in one direction and ON operation in a reverse direction, whereby providing thrust in either side direction.

14. An improvement for inboard motor boats comprising:

an inverted snorkel comprising a conduit for combustion gases exhaust extending outside the hull having an outlet aft of the transom; and an auxiliary source of thrust providing low-speed marine steering adjustments, said auxiliary source of thrust combined with the conduit for combustion gases exhaust extending outside the hull;

wherein the auxiliary source of thrust is electric powered; and wherein the inverted snorkel's conduit comprises one or more generally vertical runs which singly or collectively terminate in and exhaust out through a terminal generally vertical run;

whereby at least one of the one or more generally vertical runs serves as a ground structure for side-aimed mounting of the one and the other electric powered auxiliary sources of thrust;

said improvement for inboard motor boats further comprising a mount for the electric powered auxiliary source of thrust for side-aimed affixation of the electric powered auxiliary source of thrust relative the at least one of the one or more generally vertical runs.

15. The improvement for inboard motor boats of claim 14, further comprising:

a manually-operable controller in the helm of the boat operatively connected to the one and the other electric powered auxiliary sources of thrust enabling independent ON and OFF operation of the electric powered auxiliary sources of thrust, thereby enabling thrust in one side direction as well as thrust in the opposite side direction.

16. The improvement for inboard motor boats of claim 15, further comprising:

an automatic outer control system to render the manually-operable controller inoperable above threshold set points, and thereby not return the possibility of user control until after conditions drop below the threshold set points.

17. The improvement for inboard motor boats of claim 15, wherein:

the one and the other electric-powered auxiliary sources of thrust each comprises a drum motor and an auger affixed external of the of the drum motor.

* * * * *